US010342735B2

(12) United States Patent
Chou et al.

(10) Patent No.: US 10,342,735 B2
(45) Date of Patent: Jul. 9, 2019

(54) MULTI-MONODOSE CONTAINERS

(71) Applicant: Tokitae LLC, Bellevue, WA (US)

(72) Inventors: Fong-Li Chou, Bellevue, WA (US); Philip A. Eckhoff, Kirkland, WA (US); Lawrence Morgan Fowler, Kirkland, WA (US); Shieng Liu, Bellevue, WA (US); Krishnan Natarajan, Issaquah, WA (US); Nels R. Peterson, Bellevue, WA (US); Lowell L. Wood, Jr., Bellevue, WA (US)

(73) Assignee: Tokitae LLC, Bellevue, WA (US)

( * ) Notice: Subject to any disclaimer, the term of this patent is extended or adjusted under 35 U.S.C. 154(b) by 574 days.

(21) Appl. No.: 14/736,542

(22) Filed: Jun. 11, 2015

(65) Prior Publication Data

US 2016/0361231 A1 Dec. 15, 2016

(51) Int. Cl.

| | |
|---|---|
| ***A61J 1/14*** | (2006.01) |
| ***A61J 1/16*** | (2006.01) |
| ***A61J 1/18*** | (2006.01) |

(52) U.S. Cl.

CPC ..... *A61J 1/16* (2013.01); *A61J 1/1406* (2013.01); *A61J 1/1412* (2013.01); *A61J 1/18* (2013.01); *A61J 2200/70* (2013.01); *A61J 2200/72* (2013.01); *A61J 2205/30* (2013.01)

(58) Field of Classification Search

CPC ... A61J 2200/70; A61J 2205/30; A61J 1/1412
See application file for complete search history.

(56) References Cited

U.S. PATENT DOCUMENTS

| | | | |
|---|---|---|---|
| 1,971,863 | A | 8/1934 | Lupton |
| 1,998,147 | A | 4/1935 | Stegman |
| 2,726,004 | A | 12/1955 | McLeod |
| 2,934,867 | A | 5/1960 | Vogt |
| 3,164,934 | A | 1/1965 | Pancrantz |
| 3,245,528 | A | 4/1966 | Holley et al. |
| 3,325,860 | A | 6/1967 | Hansen |

(Continued)

FOREIGN PATENT DOCUMENTS

| | | |
|---|---|---|
| CN | 204250524 U | 4/2015 |
| DE | 1 536 138 | 10/1969 |

(Continued)

OTHER PUBLICATIONS

PCT International Search Report; International App. No. PCT/US2016/036151; dated Aug. 24, 2016; pp. 1-4.

(Continued)

*Primary Examiner* — Leslie R Deak

(57) ABSTRACT

Multi-monodose containers are described including a row of at least two vials, a first vial connected to an adjacent second vial through an articulating joint, the articulating joint sufficiently flexible to reversibly mate a planar outer surface of the first vial with a planar outer surface of the adjacent second vial; wherein the row of the at least two vials is configured to form a first rectangular packing cross-sectional area in an expanded configuration and configured to form a second rectangular packing cross-sectional area in a folded configuration, the second rectangular packing cross-sectional area smaller than the first rectangular packing cross-sectional area.

27 Claims, 10 Drawing Sheets

(56) References Cited

U.S. PATENT DOCUMENTS

| | | | | |
|---|---|---|---|---|
| 3,424,329 | A | 1/1969 | Hershberg et al. | |
| 3,498,450 | A | 3/1970 | Stevens | |
| 3,605,374 | A | 9/1971 | Mueller et al. | |
| 3,785,545 | A | 1/1974 | Roussel | |
| 3,804,423 | A | 4/1974 | Anderson | |
| 3,885,737 | A | 5/1975 | Watkins | |
| 3,936,264 | A | 2/1976 | Cornett, III et al. | |
| 3,993,223 | A | 11/1976 | Welker, III et al. | |
| 4,098,120 | A | 7/1978 | Manske | |
| 4,319,701 | A | 3/1982 | Cambio | |
| 4,643,309 | A | 2/1987 | Evers | |
| 4,856,706 | A | 8/1989 | Van Der Straten | |
| 4,919,293 | A | 4/1990 | Buckley | |
| 5,085,802 | A | 2/1992 | Jalinkski | |
| 5,254,473 | A | 10/1993 | Patel | |
| 5,503,885 | A | 4/1996 | Anderson | |
| 5,852,590 | A | 12/1998 | de la Huerga | |
| 5,984,168 | A | 11/1999 | Clark | |
| 6,234,333 | B1 | 5/2001 | Federighi et al. | |
| 6,244,501 | B1 | 6/2001 | Choi | |
| 6,544,925 | B1 | 4/2003 | Prusik et al. | |
| 6,626,308 | B2 | 9/2003 | Weiler | |
| 6,951,898 | B2 | 10/2005 | Hammond et al. | |
| 8,074,801 | B2 | 12/2011 | Slayton et al. | |
| 8,501,100 | B2 | 8/2013 | Fukui | |
| 8,707,766 | B2 | 4/2014 | Harris et al. | |
| 2002/0148855 | A1 | 10/2002 | Sokolsky et al. | |
| 2003/0054073 | A1 | 3/2003 | DelDuca et al. | |
| 2004/0094449 | A1 | 5/2004 | Schmid | |
| 2005/0261659 | A1 | 11/2005 | Mizuo et al. | |
| 2006/0177610 | A1 | 8/2006 | McAffer et al. | |
| 2009/0100802 | A1 | 4/2009 | Bush et al. | |
| 2010/0326933 | A1 | 12/2010 | Manuel et al. | |
| 2011/0081715 | A1 | 4/2011 | Robinson et al. | |
| 2011/0315269 | A1 | 12/2011 | Williamson et al. | |
| 2013/0079301 | A1 | 3/2013 | Szabocsik | |
| 2014/0346071 | A1* | 11/2014 | Genosar | A61J 1/067 206/438 |

FOREIGN PATENT DOCUMENTS

| | | | |
|---|---|---|---|
| EP | 1 746 031 | A1 | 1/2007 |
| FR | 2 129 213 | | 10/1972 |
| GB | 471446 | | 9/1937 |
| GB | 582666 | | 11/1946 |
| JP | 2000-206652 | A | 7/2000 |
| KR | 20-1993-0003779 | Y1 | 6/1993 |
| WO | WO 2014/145906 | A2 | 9/2014 |
| WO | WO 2015/036536 | A1 | 3/2015 |

OTHER PUBLICATIONS

"Advisory Committee on Immunization Practices (ACIP) Recommended Immunization Schedules for Persons Ages 0 through 18 Years and Adults Aged 19 Years and Older"; Centers for Disease Control and Prevention MMWR; Feb. 1, 2013; 21 pages; vol. 62; Office of Surveillance, Epidemiology, and Laboratory Services, Centers for Disease Control and Prevention (CDC), U.S. Department of Health and Human Services, Atlanta, GA.

Cho et al.; "A 5.1-μW UHF RFID Tag chip integrated with Sensors for Wireless Environmental Monitoring"; Proceedings of ESSCIRC; accessed Aug. 20, 2015; pp. 279-282; IEEE.

Hopkins et al.; "Large-volume IM injections: A review of best practices"; Oncology Nurse Advisor; Jan./Feb. 2013; pp. 32-37.

Kamal El Deen et al.; "The Intelligent Colorimetric Timer Indicator Systems to develop label Packaging Industry in Egypt"; International Design Journal; accessed Aug. 20, 2015; pp. 295-304; vol. 4, Issue 2.

Kartoglu et al.; "Tools and approaches to ensure quality of vaccines throughout the cold chain"; Expert Rev. Vaccines; bearing a date of Apr. 7, 2015; pp. 843-854; vol. 13, Issue 7; Informa UK Ltd.

Mills, Andrew; "Oxygen indicators and intelligent inks for packaging food"; Chemical Society Reviews; bearing a date of Jun. 20, 2005; pp. 1003-1011; vol. 34; The Royal Society of Chemistry.

"Safety Considerations for Container Labels and Carton Labeling Design to Minimize Medication Errors"; Guidance for Industry; Apr. 2013; 26 pages; U.S. Department of Health and Human Services Food and Drug Administration Center for Drug Evaluation and Research (CDER).

"Vaccine Vial Monitor"; PQS performance specification; bearing a date of Jul. 26, 2011; pp. 1-10.

PCT International Search Report; International App. No. PCT/US2016/065534; dated Mar. 30, 2017; pp. 1-4.

English translation of WO 2015/036536 (as provided by examiner).

* cited by examiner

FIG. 12A
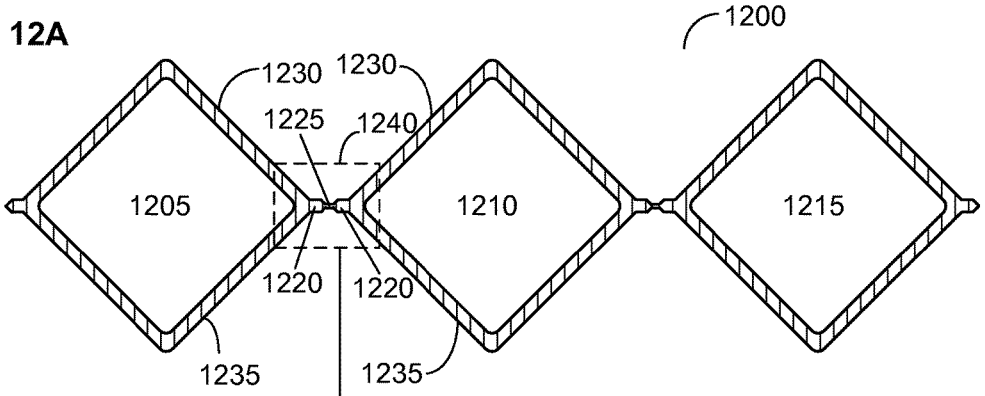
FIG. 12B
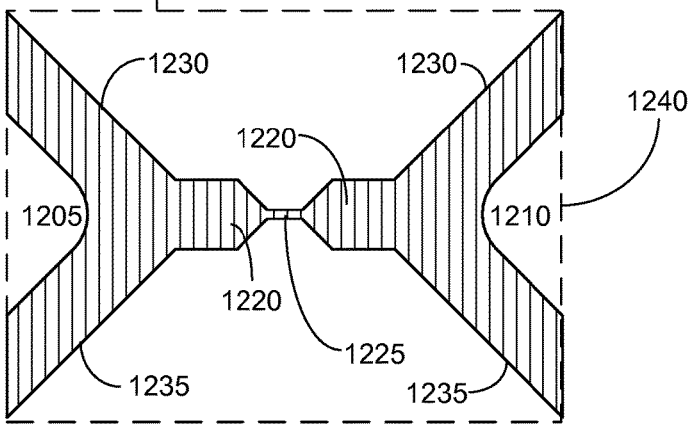
FIG. 12C
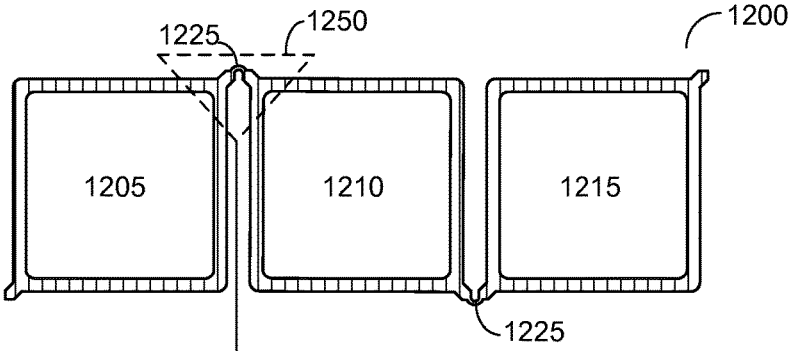
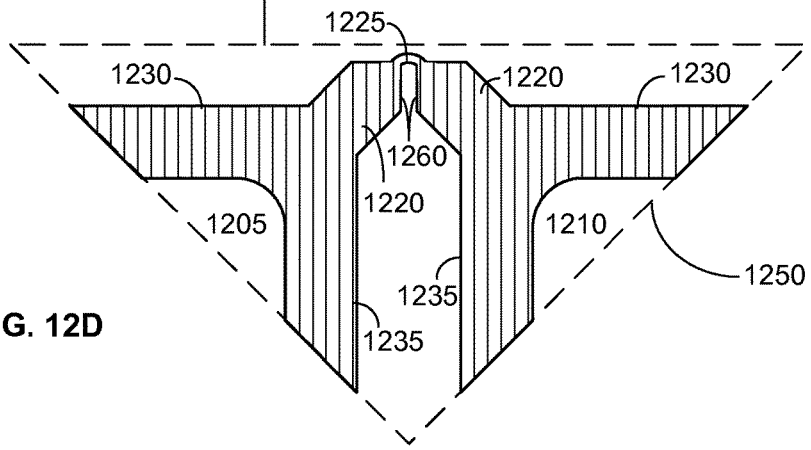
FIG. 12D

MULTI-MONODOSE CONTAINERS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

PRIORITY APPLICATIONS

None

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

SUMMARY

In an aspect, a multi-monodose container includes, but is not limited to, at least two vials including a first vial having at least two planar outer surfaces defining a first edge therebetween; a second vial having at least two planar outer surfaces defining a second edge therebetween; an articulating joint connecting the first edge and the second edge; wherein the articulating joint is sufficiently flexible to reversibly mate one of the at least two planar outer surfaces of the first vial with one of the at least two planar outer surfaces of the second vial. In addition to the foregoing, other multi-monodose container aspects are described in the claims, drawings, and text forming a part of the present disclosure.

In an aspect, a multi-monodose container includes, but is not limited to, a row of at least two vials, a first vial connected to an adjacent second vial through an articulating joint, the articulating joint sufficiently flexible to reversibly mate a planar outer surface of the first vial with a planar outer surface of the adjacent second vial; wherein the row of the at least two vials is configured to form a first rectangular packing cross-sectional area in an expanded configuration and configured to form a second rectangular packing cross-sectional area in a folded configuration, the second rectangular packing cross-sectional area smaller than the first rectangular packing cross-sectional area. In addition to the foregoing, other multi-monodose container aspects are described in the claims, drawings, and text forming a part of the present disclosure.

In an aspect, a multi-monodose container includes, but is not limited to, a row of at least two vials interconnected by at least one articulating joint, the row of at least two vials including at least one pair of reversibly mating planar outer surfaces and at least one pair of non-mating planar outer surfaces, the row of at least two vials configured to form an expanded configuration and configured to form a folded configuration, the folded configuration including the at least one pair of reversibly mating planar outer surfaces parallel to one another and the at least one pair of non-mating planar outer surfaces forming a substantially planar outer surface of the row of at least two vials. In addition to the foregoing, other multi-monodose container aspects are described in the claims, drawings, and text forming a part of the present disclosure.

In an aspect, a multi-monodose container includes, but is not limited to, a row of at least two vials, each of the at least two vials having four walls connected to a rectangular base to define an internal volume, each of the four walls including a planar outer surface, a first planar outer surface and a second planar outer surface defining a first edge therebetween, the second planar outer surface and a third planar outer surface defining a second edge therebetween, the third planar outer surface and a fourth planar outer surface defining a third edge therebetween, and the fourth planar outer surface and the first planar outer surface defining a fourth edge therebetween; an articulating joint connecting the third edge of a first vial to the first edge of a second vial, the articulating joint sufficiently flexible to reversibly mate the first or the second planar outer surface of the second vial with the third or fourth planar outer surface of the first vial; the row of at least two vials configured to form a first rectangular packing cross-sectional area in an expanded configuration and configured to form a second rectangular packing cross-sectional area in a folded configuration, the second rectangular packing cross-sectional area smaller than the first rectangular packing cross-sectional area. In addition to the foregoing, other multi-monodose container aspects are described in the claims, drawings, and text forming a part of the present disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

FIG. 12A is a top-down horizontal cross-sectional view through a schematic of a multi-monodose container with double-beveled edges and in an expanded configuration.

FIG. 12B is enlarged view of the double-beveled edges such as shown in FIG. 12A.

FIG. 12C is a top-down horizontal cross-sectional view through a schematic of a multi-monodose container with double-beveled edges and in a folded configuration.

FIG. 12D is enlarged view of the double-beveled edges such as shown in FIG. 12C.

DETAILED DESCRIPTION

Figure 1A:
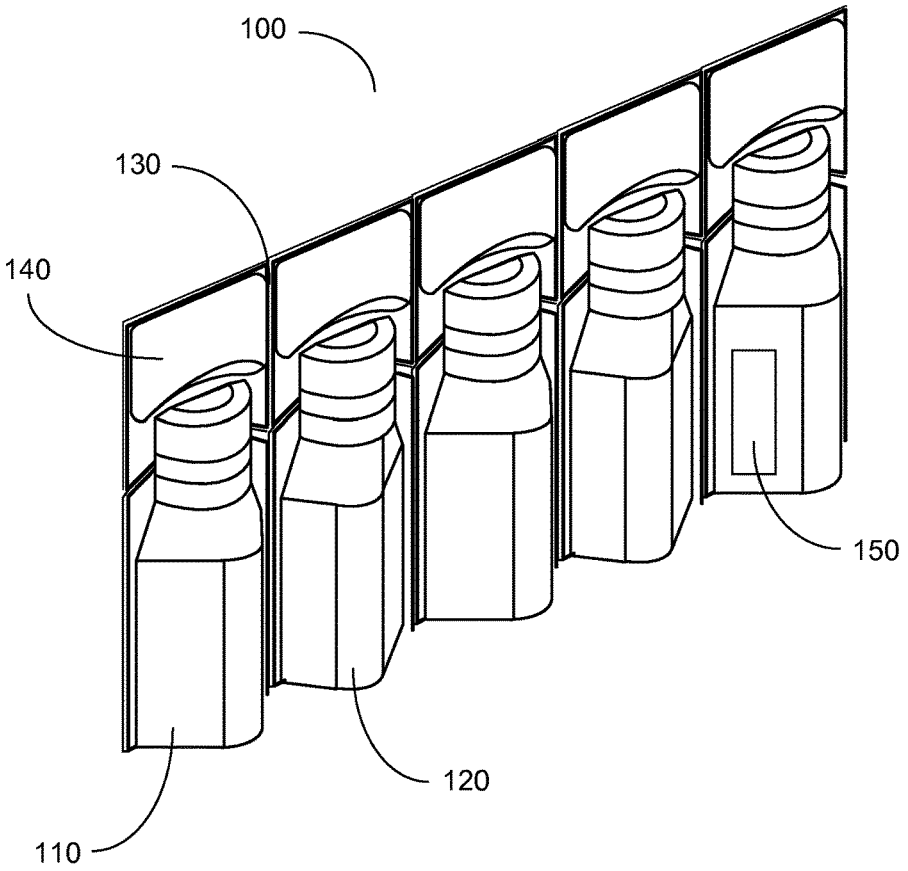
FIG. 1A is a schematic of a multi-monodose container in an expanded configuration.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Described herein are multi-monodose containers. A multi-monodose container includes a row of interconnected vials, e.g., pharmaceutical vials. Each of the interconnected vials is configured to hold at least one dose of a pharmaceutical agent. The vials are connected to one another by articulating joints. The articulating joints are configured to allow the position of an individual vial to be altered relative to each other vial during times of storage versus times of use, while maintaining the interconnectivity of the vials. The vials in the multi-monodose container are configured to fold into a small footprint during storage and transport for space-efficiency and to expand into a larger footprint during use for ease in accessing a pharmaceutical agent stored therein. In some embodiments, the vials in the multi-monodose container are separable from one another for further ease of use.

With reference to FIG. 1A, shown is an example of a multi-monodose container which can serve as a context for one or more devices, systems, and/or methods described herein. FIG. 1A shows an illustration of multi-monodose container 100. In this non-limiting example, multi-monodose container 100 includes a row of five interconnected vials. In an aspect, each of the vials is configured to hold a single-dose volume of a pharmaceutical agent, e.g., a vaccine. Each of the vials is connected to at least one adjacent vial through an articulating joint. For example, a first vial 110 is connected to a second vial 120 through an articulating joint 130. The articulating joint 130 is sufficiently flexibly to reversibly mate a planar outer surface of the first vial 110 with a planar outer surface of the second vial 120. Each of the vials includes a closure covering an access portion. For example, first vial 110 is shown including removable cap 140 covering an access portion, e.g., an opening into the vial. In some embodiments, the closure covering the access portion includes an insert, e.g., an elastomeric septum. Multi-monodose container 100 further includes at least one label 150 including information regarding the pharmaceutical agent stored within each of the vials forming the multi-monodose container.

Figure 1B:
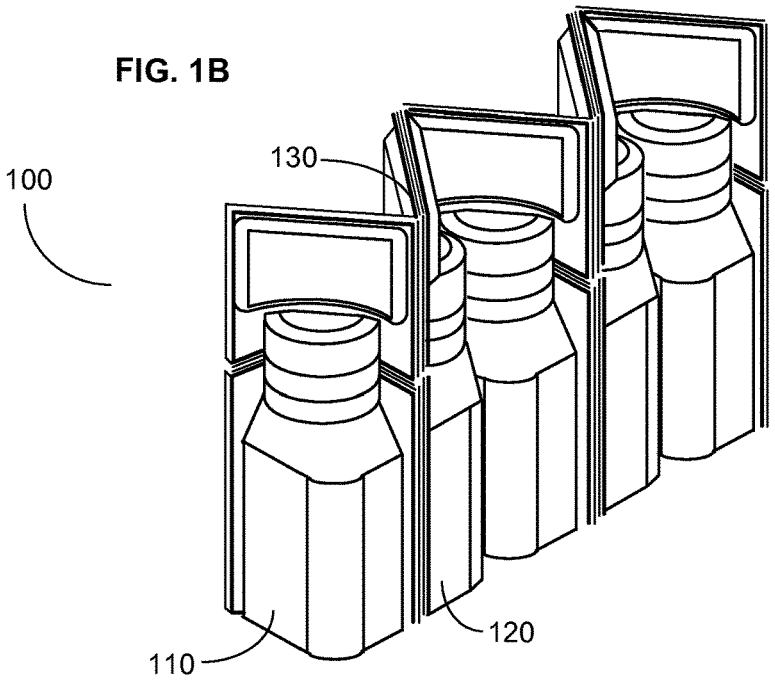
FIG. 1B is a schematic of a multi-monodose container in a folded configuration.

In FIG. 1A, multi-monodose container 100 is shown in an expanded configuration. FIG. 1B shows an illustration of multi-monodose container 100 in a folded configuration. Articulating joint 130 is bent to allow a planar outer surface of vial 110 to reversibly mate with a planar outer surface of vial 120. The folded configuration of multi-monodose container 100 includes alternating bending or folding of the articulating joints, resulting in the formation of a linear folded structure. The footprint of multi-monodose container 100 is reduced in the folded configuration as shown in FIG. 1B relative to the footprint of multi-monodose container 100 in the expanded configuration as shown in FIG. 1A.

In an aspect, each of the vials in the multi-monodose container includes an internal volume configured to hold a pharmaceutical agent. In some embodiments, the pharmaceutical agent is in a liquid form. In some embodiments, the pharmaceutical agent is in a powder form requiring reconstitution with a liquid, e.g., sterile diluent or water-for-injection, prior to administration. In an aspect, the pharmaceutical agent is formulated for parenteral administration. For example, the pharmaceutical agent can include a vaccine or therapeutic agent formulated for intramuscular, intradermal, or subcutaneous injection. In an aspect, the pharmaceutical agent is formulated for oral administration. For example, the pharmaceutical agent can include a vaccine or therapeutic agent formulated for oral or sublingual administration. In an aspect, the pharmaceutical agent is formulated for intranasal administration.

In some embodiments, each of the at least two vials of a multi-monodose container includes an internal volume configured to hold a single dose of a pharmaceutical agent. For example, the internal volume of a vial can be configured to be equal to or greater than a single-dose volume of a pharmaceutical agent. In an aspect, each of the at least two vials of a multi-monodose container includes an internal volume configured to hold two doses of a pharmaceutical agent. For example, the internal volume of a vial can be configured to be equal to or greater than twice a single-dose volume of a pharmaceutical agent. In an aspect, each of the at least two vials of a multi-monodose container includes an internal volume configured to hold two or more doses of a pharmaceutical agent.

In an aspect, each of the at least two vials includes a closure covering an access portion. In some embodiments, the closure includes a removable cap 140. In some embodiments, the removable cap is snapped or twisted off to reveal an access portion of the vial. In an aspect, the access portion is an opening or aperture defined by the walls of the vial. For example, the removable cap can be snapped or twisted off to reveal an opening or aperture through which the enclosed pharmaceutical agent can be accessed. In an aspect, the closure includes a needle-penetrable closure. For example, the closure can include a needle-penetrable material through which a needle attached to a syringe is able to penetrate to access the internal volume of a vial. For example, the closure can include a removable cap that is snapped or twisted off to reveal a needle-penetrable material, e.g., an elastomeric septum, through which a needle attached to a syringe can access the internal volume of a vial.

Figure 2:
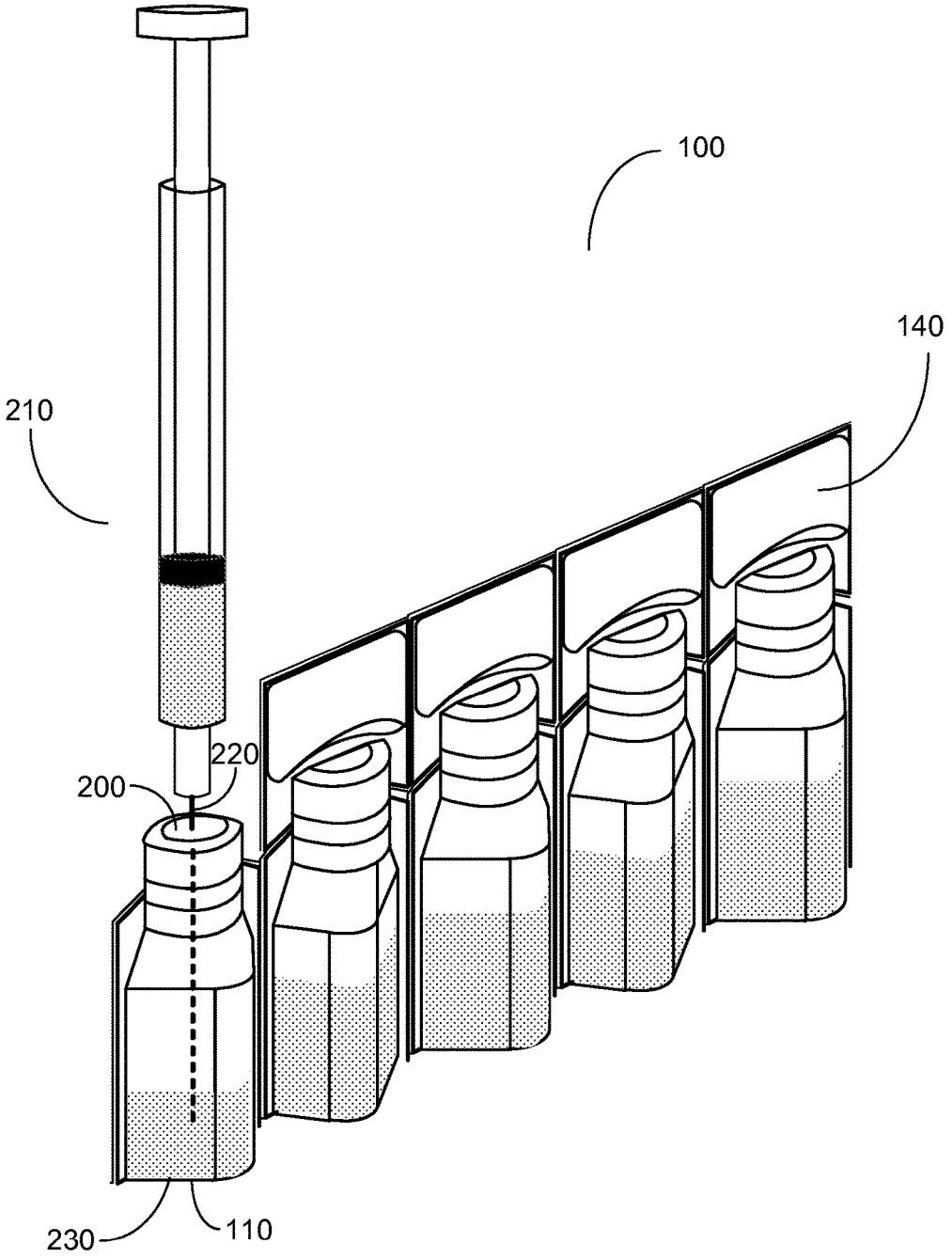
FIG. 2 is a schematic of a multi-monodose container in an expanded configuration with a syringe apparatus.

FIG. 2 illustrates further aspects of a multi-monodose container. In some embodiments, each of the at least two vials forming the multi-monodose container includes an internal volume configured to hold a single parenteral dose of a pharmaceutical agent, e.g., a vaccine or therapeutic agent. For example, the internal volume of each of the at least two vials forming a multi-monodose container can be configured to hold a single parenteral dose of a vaccine or a therapeutic agent in a liquid form. In an aspect, a liquid form of a single parenteral dose of a pharmaceutical agent is removed from a vial through a closure, e.g., a needle-penetrable closure, of the vial using a syringe with an attached needle. In an aspect, a liquid form of a single parenteral dose of a pharmaceutical agent is removed from a vial through an access portion, e.g., an opening or aperture, using a syringe with an attached needle or using a needle-less syringe with a Luer taper connection. For example, in some embodiments, the pharmaceutical agent stored in a vial of the multi-monodose container is accessed using a syringe apparatus including a needle. FIG. 2 shows multi-monodose container 100 in which the removable cap 140 has been removed from the first vial 110 to reveal an access portion 200. Access portion 200 can include an aperture or opening. In some embodiments, access portion 200 includes an insert, e.g., a needle-penetrable closure such as, for example, an elastomeric septum. Also shown is a syringe apparatus 210 including a needle 220 accessing the liquid contents 230 (illustrated as stippling) of the first vial 110 through the access portion 200. In some embodiments, needle 220 accesses the liquid contents 230 of first vial 110 through a needle-penetrable closure, e.g., a needle-penetrable portion of the vial or a needle-penetrable insert, e.g., an elastomeric septum.

In an aspect, a multi-monodose container includes at least two vials including a first vial having at least two planar outer surfaces defining a first edge therebetween; a second vial having at least two planar outer surfaces defining a second edge therebetween; an articulating joint connecting the first edge and the second edge; wherein the articulating joint is sufficiently flexible to reversibly mate one of the at least two planar outer surfaces of the first vial with one of the at least two planar outer surfaces of the second vial. In an aspect, the at least two vials and the articulating joint are configured to form an expanded configuration and configured to form a folded configuration. In an aspect, the folded configuration comprises the one of the at least two planar outer surfaces of the first vial parallel to the one of the at least two planar outer surfaces of the second vial.

In some embodiments, a multi-monodose container includes a row of at least two vials interconnected by at least one articulating joint, the row of at least two vials including at least one pair of reversibly mating planar outer surfaces and at least one pair of non-mating planar outer surfaces, the row of at least two vials configured to form an expanded configuration and configured to form a folded configuration, the folded configuration including the at least one pair of reversibly mating planar outer surfaces parallel to one another and the at least one pair of non-mating planar outer surfaces forming a substantially planar outer surface of the row of at least two vials.

Figure 3A:
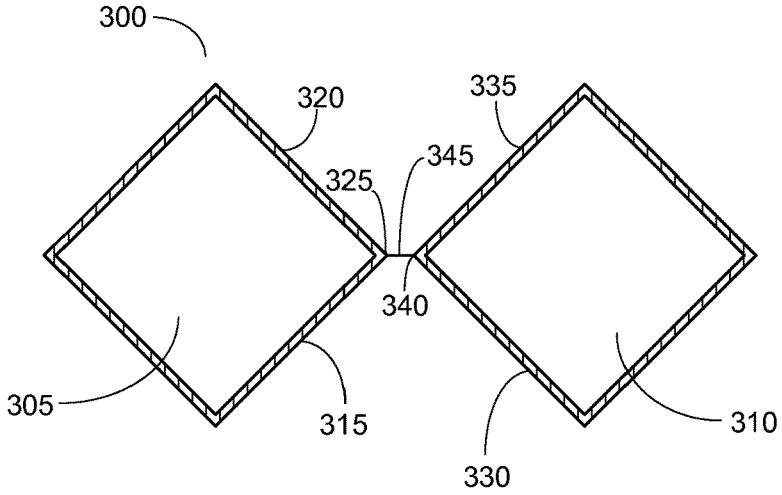
FIG. 3A is a top-down horizontal cross-sectional view through a schematic of a multi-monodose container in an expanded configuration.
Figure 3B:
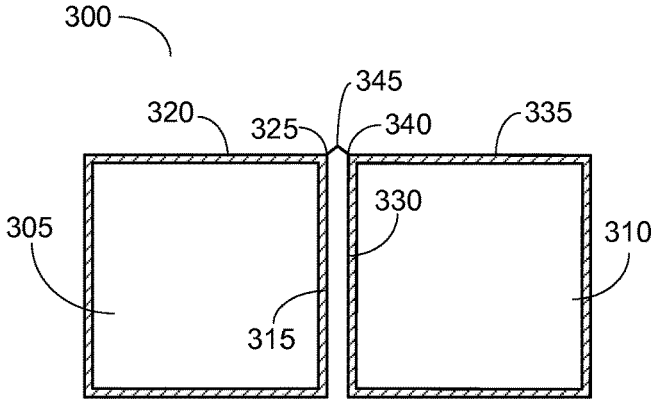
FIG. 3B is a top-down horizontal cross-sectional view through a schematic of a multi-monodose container in a folded configuration.
Figure 3C:
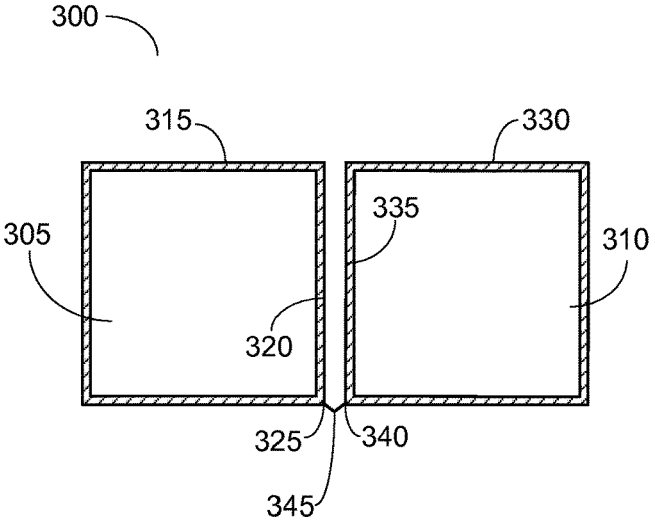
FIG. 3C is a top-down horizontal cross-sectional view through a schematic of a multi-monodose container in a folded configuration.

FIGS. 3A, 3B, and 3C illustrate aspects of a multi-monodose container including at least two vials. FIG. 3A shows a diagram of a top-down view of a cross-section through a multi-monodose container 300 including at least two vials in an expanded configuration. Multi-monodose container 300 includes a first vial 305 and a second vial 310. First vial 305 includes a first planar outer surface 315 and a second planar outer surface 320 defining first edge 325 therebetween. Second vial 310 includes a first planar outer surface 330 and a second planar outer surface 335 defining second edge 340 therebetween. Multi-monodose container 300 further includes articulating joint 345 connecting the first edge 325 of first vial 305 and the second edge 340 of second vial 310. Articulating joint 345 is sufficiently flexible to reversibly mate one of the at least two planar outer surfaces of the first vial 305 with one of the at least two planar outer surfaces of the second vial 310.

FIGS. 3B and 3C illustrate aspects of multi-monodose 300 in a folded configuration in which articulating joint 345 connecting first edge 325 of first vial 305 and second edge 340 of second vial 310 has been bent in a first or a second direction. FIG. 3B shows a diagram of a top-down view of a horizontal cross-section through multi-monodose container 300 in a first folded configuration in which articulating joint 345 connecting first edge 325 of first vial 305 and second edge 340 of second vial 310 has been bent in a first direction. In the first folded configuration, first planar outer surface 315 of the first vial 305 is reversibly mated with the first planar outer surface 330 of the second vial 310. The first planar outer surface 315 of the first vial 305 and the first planar outer surface 330 of the second vial 310 form a pair of reversibly mating planar outer surfaces. In this first folded configuration, the pair of reversibly mating planar outer surfaces, i.e., first planar outer surface 315 and first planar outer surface 330, are parallel to one another. The second planar outer surface 320 of the first vial 305 and the second planar outer surface 335 of the second vial 310 form a pair of non-mating planar outer surfaces. In this first folded configuration, the pair of non-mated planar outer surfaces, i.e., second planar outer surface 320 and the second planar outer surface 335, form a substantially planar outer surface of the row of at least two vials comprising multi-monodose container 300.

FIG. 3C shows a diagram of a top-down view of a horizontal cross-section through multi-monodose container 300 in a second folded configuration in which articulating joint 345 connecting first edge 325 of first vial 305 and second edge 340 of second vial 310 has been bent in a second direction. In the second folded configuration, second planar outer surface 320 of the first vial 305 is reversibly mated with the second planar outer surface 335 of the second vial 310. The second planar outer surface 320 of the first vial 305 and the second planar outer surface 335 of the second vial 310 form a pair of reversibly mating planar outer surfaces. In this second folded configuration, the pair of reversibly mating planar outer surfaces, i.e., second planar outer surface 320 and second planar outer surface 335, are parallel to one another. The first planar outer surface 315 of the first vial 305 and the first planar outer surface 330 of the second vial 310 form a pair of non-mating planar outer surfaces. In this second folded configuration, the pair of non-mated planar outer surfaces, i.e., the first planar outer surface 315 and the first planar outer surface 330, form a substantially planar outer surface of the row of at least two vials comprising multi-monodose container 300.

In some embodiments, a multi-monodose container includes a row of at least two vials, each of the at least two vials having four walls connected to a rectangular base to define an internal volume, each of the four walls including a planar outer surface, a first planar outer surface and a second planar outer surface defining a first edge therebetween, the second planar outer surface and a third planar outer surface defining a second edge therebetween, the third planar outer surface and a fourth planar outer surface defining a third edge therebetween, and the fourth planar outer surface and the first planar outer surface defining a fourth edge therebetween; an articulating joint connecting the third edge of a first vial to the first edge of a second vial, the articulating joint sufficiently flexible to reversibly mate the first or the second planar outer surface of the second vial with the third or fourth planar outer surface of the first vial; the row of the at least two vials configured to form a first rectangular packing cross-sectional area in an expanded configuration and configured to form a second rectangular packing cross-sectional area in a folded configuration, the second rectangular packing cross-sectional area smaller than the first rectangular packing cross-sectional area.

Figure 4A:
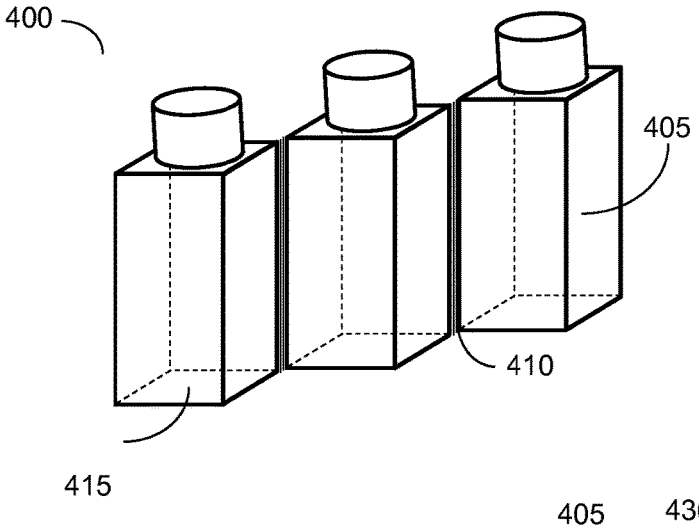
FIG. 4A is a schematic of a multi-monodose container in an expanded configuration.
Figure 4B:
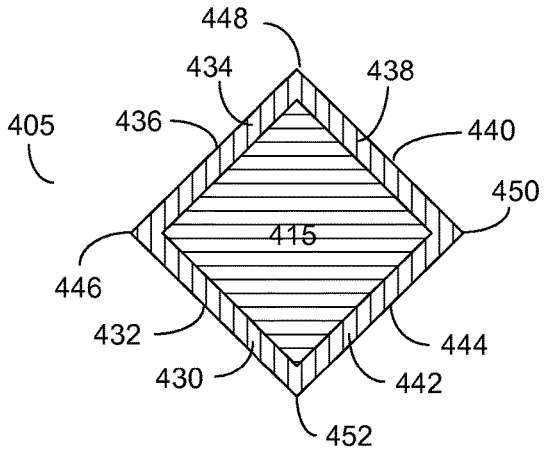
FIG. 4B is a top-down view of a horizontal cross-section through a vial of a multi-monodose container such as shown in FIG. 4A.

FIGS. 4A-4D illustrate aspects of a non-limiting example of a multi-monodose container including vials with four walls and a rectangular base. FIG. 4A shows an illustration of multi-monodose container 400 in an expanded configuration. Multi-monodose container 400 includes a row of at least two vials 405, each of the at least two vials 405 having four walls connected to a rectangular base 415 to define an internal volume. Multi-monodose container 400 further includes an articulating joint 410 connecting the edge of vial 405 to an adjacent vial. FIG. 4B is a top-down view through a horizontal cross-section of vial 405. Vial 405 includes four walls 430, 434, 438, and 442 connected to rectangular base 415 to define an internal volume. Each of the four walls 430, 434, 438, and 442 includes a planar outer surface. A first planar outer surface 432 and a second planar outer surface 436 define a first edge 446 therebetween; the second planar outer surface 436 and a third planar outer surface 440 define a second edge 448 therebetween; the third planar outer surface 440 and a fourth planar outer surface 444 define a third edge 450 therebetween; and the fourth planar outer surface 444 and the first planar outer surface 432 define a fourth edge 452 therebetween.

Figure 4C:
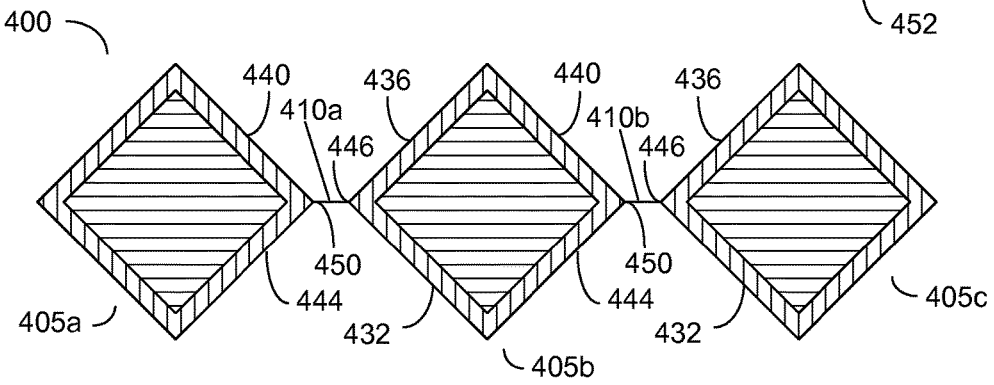
FIG. 4C is a top-down view of a horizontal cross-section through a row of vials of a multi-monodose container such as shown in FIG. 4A in an expanded configuration.
Figure 4D:
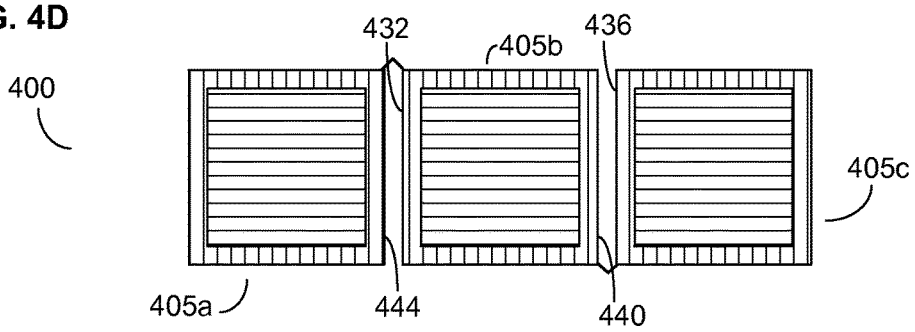
FIG. 4D is a top-down view of a horizontal cross-section through a row of vials of a multi-monodose container such as shown in FIG. 4A in a folded configuration.

In an aspect, the multi-monodose container 400 includes a second articulating joint connecting the third edge of the second vial to a first edge of a third vial, the second articulating joint sufficiently flexible to reversibly mate a first or a second planar outer surface of the third vial with the third or the fourth planar outer surface of the second vial. FIG. 4C shows a top-down view through a horizontal cross-section of multi-monodose container 400 in an expanded configuration. In this non-limiting example, multi-monodose container 400 includes three vials 405*a*, 405*b*, and 405*c*. The third edge 450 of vial 405*a* is connected to the first edge 446 of vial 405*b* through articulating joint 410*a*. Similarly, the third edge 450 of vial 405*b* is connected to the first edge 446 of vial 405*c* through articulating joint 410*b*. To form a folded configuration, articulating joint 410*a* is sufficiently flexible to reversibly mate the first planar outer surface 432 or the second planar outer surface 436 of the vial 405*b* with the third planar outer surface 440 or fourth planar outer surface 444 of vial 405*a* and articulating joint 410*b* is sufficiently flexible to reversibly mate the first planar outer surface 432 or the second planar outer surface 436 of the vial 405*c* with the third planar outer surface 440 or fourth planar outer surface 444 of vial 405*b*. FIG. 4D shows a top-down view through a horizontal cross-section of multi-monodose container 400 in the folded configuration. In this non-limiting example, the first planar outer surface 432 of vial 405*b* and the fourth planar outer surface 444 of vial 405*a* are reversibly mated and the second planar outer surface 436 of vial 405*c* and the third planar outer surface 440 of vial 405*b* are reversibly mated to form the folded configuration. The interconnected row of vials 405*a*, 405*b*, and 405*c* form a first rectangular packing cross-sectional area in the expanded configuration shown in FIG. 4C and form a second rectangular packing cross-sectional area in the folded configuration shown in FIG. 4D. The second rectangular packing cross-sectional area is smaller than the first rectangular packing cross-sectional area.

In an aspect, the at least two vials are polygonal in horizontal cross-section. For example, the at least two vials of a multi-monodose container can include a polygon with three or more sides in horizontal cross-section. For example, the at least two vials of the multi-monodose container can have a horizontal cross-section that is a triangle, a square, a rectangle, a trapezoid, a pentagon, a hexagon, a heptagon, an octagon, a nonagon, or a decagon. In an aspect, the at least two vials are square in horizontal cross-section.

Figure 5A:
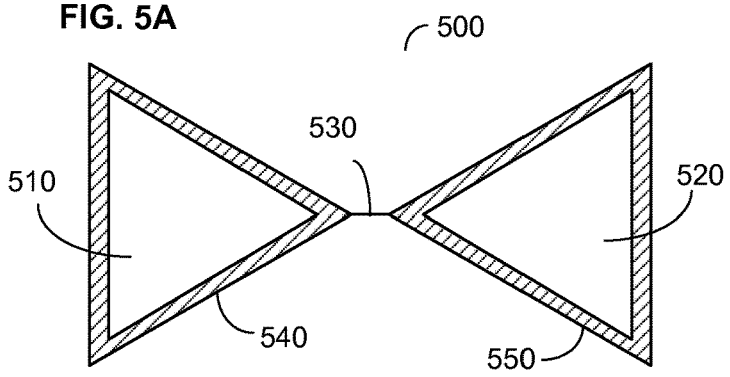
FIG. 5A is a top-down horizontal cross-sectional view through a schematic of a multi-monodose container in an expanded configuration.
Figure 5B:
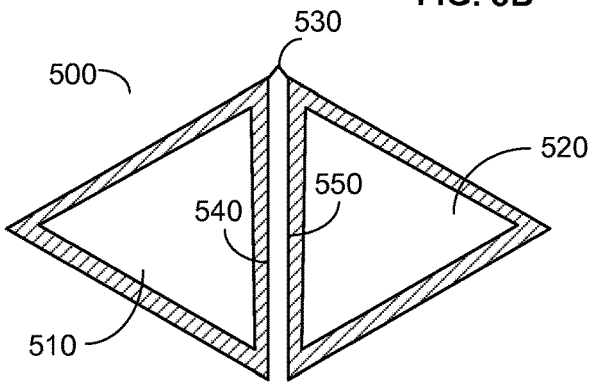
FIG. 5B is a top-down horizontal cross-sectional view through a schematic of a multi-monodose container in a folded configuration.

In an aspect, the at least two vials are triangular in horizontal cross-section. FIGS. 5A and 5B illustrate a multi-monodose container including vials that are triangular in horizontal cross-section. FIG. 5A shows a diagram of a top-down view of a horizontal cross-section through multi-monodose container 500 in an expanded configuration. Multi-monodose container 500 includes a first vial 510 and a second vial 520 connected through articulating joint 530. A first planar outer surface 540 of first vial 510 is configured to reversibly mate with a first planar outer surface 550 of second vial 520. FIG. 5B shows a diagram of a top-down view of a cross-section through multi-monodose container 500 in a folded configuration. Articulating joint 530 is bent to reversibly mate, i.e., bring into proximity, the first planar outer surface 540 of the first vial 510 with the first planar outer surface 550 of the second vial 520. In an aspect, a multi-monodose container having vials with a triangular cross-section such as exemplified in FIGS. 5A and 5B can have at least two vials. In an aspect, a multi-monodose container having vials with a triangular cross-section can have more than two vials.

Figure 6A:
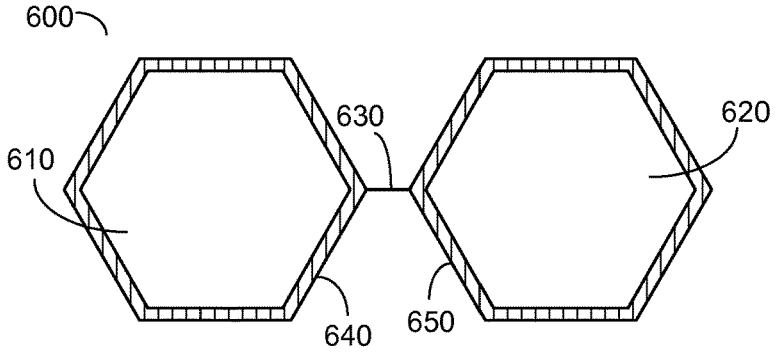
FIG. 6A is a top-down horizontal cross-sectional view through a schematic of a multi-monodose container in an expanded configuration.
Figure 6B:
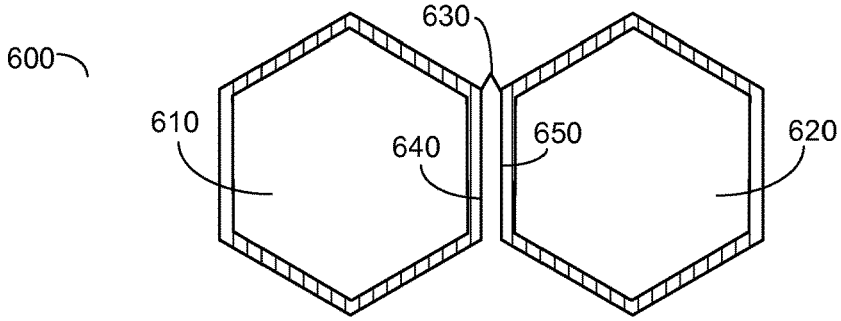
FIG. 6B is a top-down horizontal cross-sectional view through a schematic of a multi-monodose container in a folded configuration.

In an aspect, the at least two vials are hexagonal in horizontal cross-section. FIGS. 6A and 6B illustrate a multi-monodose container including vials with a hexagonal horizontal cross-section. FIG. 6A shows a diagram of a top-down view of a cross section through multi-monodose container 600 in an expanded configuration. Multi-monodose container 600 includes a first vial 610 and a second vial 620 connected through articulating joint 630. A first planar outer surface 640 of first vial 610 is configured to reversibly mate with a first planar outer surface 650 of second vial 620. FIG. 6B shows a diagram of a top-down view of a cross-section through multi-monodose container 600 in a folded configuration. Articulating joint 630 is bent to reversibly mate, i.e., bring into proximity, the first planar outer surface 640 of the first vial 610 with the first planar outer surface 650 of the second vial 620. In an aspect, a multi-monodose container having vials with a hexagonal cross-section such as exemplified in FIGS. 6A and 6B can have at least two vials. In an aspect, a multi-monodose container having vials with a hexagonal cross section can have more than two vials.

Figure 7A:
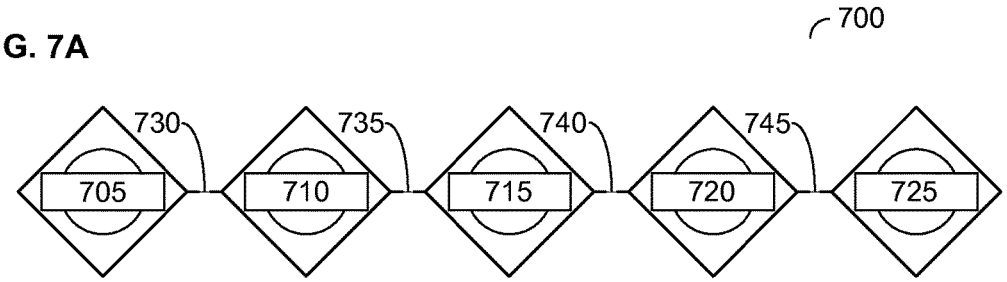
FIG. 7A is a top-down view of a schematic of a multi-monodose container in an expanded configuration.

In an aspect, a multi-monodose container is configured to form an expanded configuration and a folded configuration. In an aspect, the at least two vials and the articulating joint are configured to form an expanded configuration and configured to form a folded configuration. In an aspect, the folded configuration includes one of the at least two planar outer surfaces of a first vial parallel to one of the at least two planar outer surfaces of the second vial. FIGS. 7A-7E illustrate aspects of a non-limiting example of a multi-monodose container in an expanded configuration and in one of two folded configurations. FIG. 7A shows a diagram of a top-down view of a multi-monodose container 700 in an expanded configuration. In an aspect, a multi-monodose container includes at least one third vial and at least one additional articulating joint. In this non-limiting example, multi-monodose container 700 includes five vials, i.e., vials 705, 710, 715, 720, and 725, and four articulating joints. Articulating joint 730 connects vials 705 and 710, articulating joint 735 connects vials 710 and 715, articulating joint 740 connects vials 715 and 720, and articulating joint 745 connects vials 720 and 725. In an aspect, articulating joints 730, 735, 740, and 745 are sufficiently flexible to reversibly mate a planar outer surface of one vial to a planar outer surface of an adjacent vial.

Figure 7B:
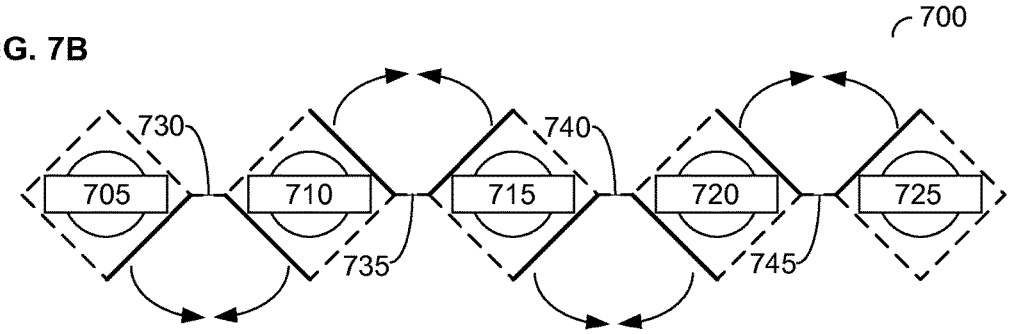
FIG. 7B is a top-down view of a first folding pattern of a multi-monodose container.
Figure 7C:
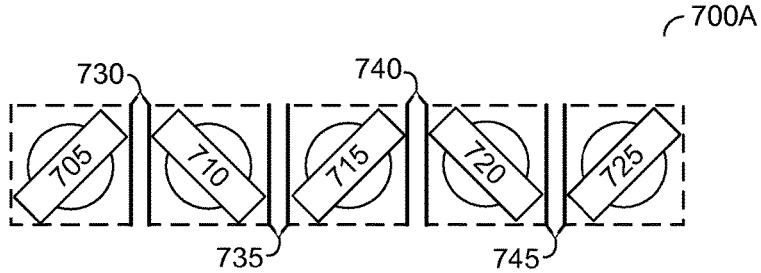
FIG. 7C is a top-down view of a schematic of a multi-monodose container in a first folded configuration.

FIGS. 7B and 7C illustrate bending of the articulating joints of multi-monodose container 700 to form a first folded configuration. FIG. 7B shows a diagram of a top-down view of multi-monodose container 700 in the expanded configuration. The planar outer surfaces of vials 705, 710, 715, 720, and 725 form pairs of reversibly mating planar outer surfaces (solid lines) or pairs of non-mating planar outer surfaces (dotted lines). Articulating joints 730, 735, 740, and 745 are bent as indicated by the converging arrowheads to bring the pairs of reversibly mating planar outer surfaces into closer proximity. FIG. 7C shows a diagram of a top-down view of multi-monodose container 700A in a first folded configuration in which the pairs of reversibly mating planar outer surfaces (solid lines) of vials 705, 710, 715, 720, and 725 have been brought together by bending articulating joints 730, 735, 740, and 745. The pairs of reversibly mating planar outer surfaces are parallel to one another. The pairs of non-mating planar outer surfaces form a substantially planar outer surface of the row of vials 705, 710, 715, 720, and 725 comprising multi-monodose container 700.

Figure 7D:
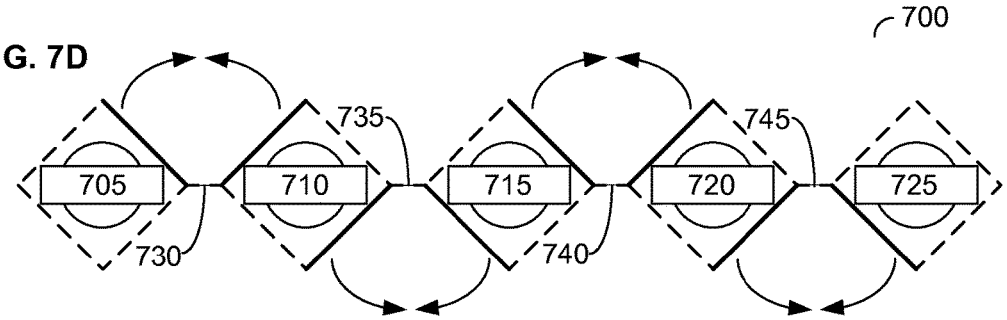
FIG. 7D is a top-down view of a second folding pattern of a multi-monodose container.
Figure 7E:
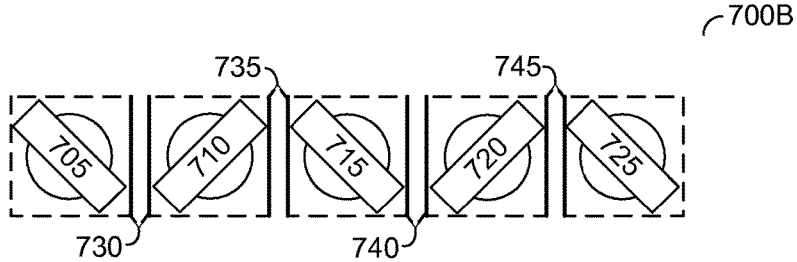
FIG. 7E is a top-down view of a schematic of a multi-monodose container in a second folded configuration.

FIGS. 7D and 7E illustrate bending of the articulating joints of multi-monodose container 700 to form a second folded configuration. FIG. 7D shows a diagram of a top-down view of multi-monodose container 700 in the expanded configuration. The planar outer surfaces of vials 705, 710, 715, 720, and 725 form pairs of reversibly mating planar outer surfaces (solid lines) or pairs of non-mating planar outer surfaces (dotted lines). Articulating joints 730, 735, 740, and 745 are bent as indicated by the converging arrowheads to bring the reversibly mating pairs of planar outer surfaces into closer proximity. FIG. 7E shows a diagram of a top-down view of multi-monodose container 700B in a second folded configuration in which the pairs of reversibly mating planar outer surfaces (solid lines) of vials 705, 710, 715, 720, and 725 have been brought together by bending articulating joints 730, 735, 740, and 745. The pairs of reversibly mating planar outer surfaces are parallel to one another. The pairs of non-mating planar outer surfaces (dotted lines) form a substantially planar outer surface of the row of vials 705, 710, 715, 720, and 725 comprising multi-monodose container 700.

In an aspect, a multi-monodose container includes a row of at least two vials. In an aspect, a multi-monodose container includes a row of at least two pharmaceutical vials. In an aspect, the at least two vials includes two vials, three vials, four vials, five vials, six vials, seven vials, eight vials, nine vials, or ten vials. In an aspect, the multi-monodose container includes a row of 2 to 30 vials. For example, a multi-monodose container includes 2 vials, 3 vials, 4 vials, 5 vials, 6 vials, 7 vials, 8 vials, 9 vials, 10 vials, 11 vials, 12 vials, 13 vials, 14 vials, 15 vials, 16 vials, 17 vials, 18 vials, 19 vials, 20 vials, 21 vials, 22 vials, 23 vials, 24 vials, 25 vials, 26 vials, 27 vials, 28 vials, 29 vials, or 30 vials. In some embodiments, the multi-monodose container includes more than 30 vials.

In an aspect, a multi-monodose container includes a row of 20 to 30 vials. For example, a multi-monodose container can include a row of 25 vials. In an aspect, a multi-monodose container includes a row of 20 to 30 vials configured to be split into groups of 3 to 10 vials. For example, a multi-monodose container includes a row of 20 to 30 vials configured to be split into groups of 3 vials, 4 vials, 5 vials, 6 vials, 7 vials, 8 vials, 9 vials, or 10 vials. For example, a multi-monodose container can include a strip of 25 vials that is configured to be split into groups of 5 vials.

In an aspect, each of the vials in a row of vials is connected to an adjacent vial through a flexible articulating joint. In an aspect, the articulating joint is cleavable. For example, an articulating joint connecting a first vial and a second vial can be cleavable, allowing for separation of the first vial from the second vial. In an aspect, the articulating joint is at least one of tearable, ripable, rendable, breakable, fragmentable, frangible, or separable. For example, an articulating joint connecting a first vial and a second vial can be at least one of tearable, ripable, rendable, breakable, fragmentable, frangible, or separable. In an aspect, a subset of articulating joints connecting the at least two vials in a multi-monodose container are cleavable. For example, the subset of cleavable articulating joints may be used to separate a large multi-monodose container, e.g., with 25 vials, into smaller multi-monodose containers, e.g., with 5 vials. In an aspect, all of the articulating joints connecting the at least two vials in a multi-monodose container are cleavable. For example, cleavable articulating joints may be used to detach or separate each vial from the other vials of the multi-monodose container.

Figure 8A:
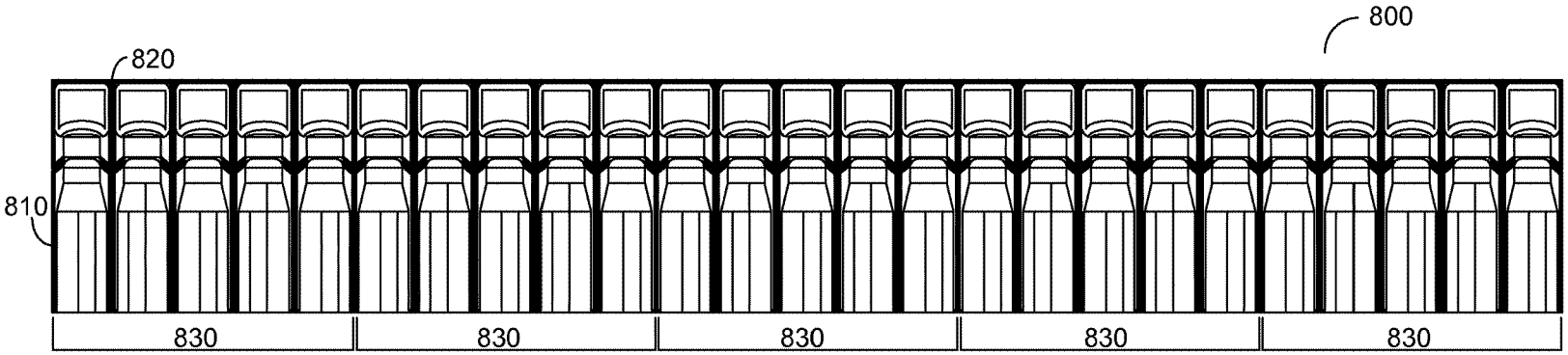
FIG. 8A is a side view of a strip of interconnected vials.
Figure 8B:
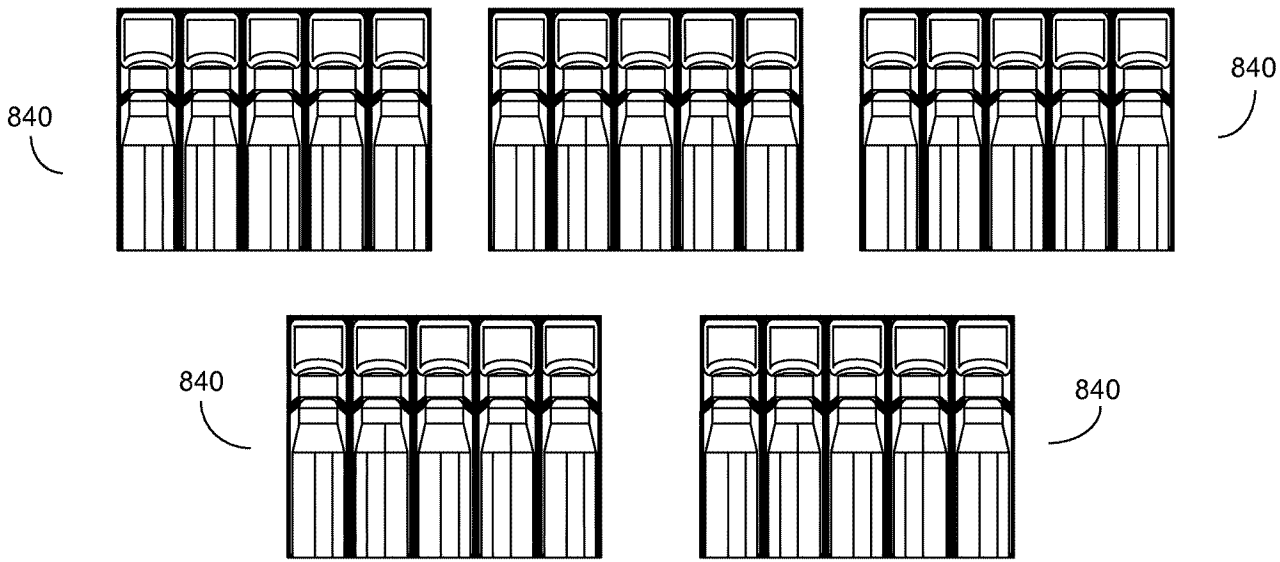
FIG. 8B is a side view of several multi-monodose containers derived from a strip of vials.

FIGS. 8A and 8B illustrate aspects of a multi-monodose container configured to subdivide into smaller multi-monodose container units. FIG. 8A shows a side view of a multi-monodose container 800 including a long row of interconnected vials. In this non-limiting example, the multi-monodose container 800 includes a row of 25 individual vials 810. Each of the individual vials 810 is connected to an adjacent vial through an articulating joint 820. In an aspect, a multi-monodose container, such as shown in FIG. 8A is manufactured as a single row of interconnected vials. For example, a mold for use in blow molding, injection molding, or blow-fill-seal manufacturing can include molds for 25 individual vials interconnected through articulating joints. For example, a multi-monodose container including 25 individual vials can be manufactured, filled with appropriate pharmaceutical agent, sealed, and packaged in the folded configuration for ease of distribution.

In an aspect, multi-monodose container 800 is configured to separate, break, or subdivide into smaller units as indicated by the brackets 830 of FIG. 8A. For example, multi-monodose container 800 such as shown in FIG. 8A can be separated into smaller multi-monodose containers. FIG. 8B illustrates an example in which the multi-monodose container 800 of FIG. 8A including 25 individual vials 810 is separated into five multi-monodose containers 840. Each of the multi-monodose containers 840 includes five individual vials. In this way, large strips of interconnected vials can be manufactured, filled with pharmaceutical agent, sealed, and subsequently separated into smaller units for packaging (e.g., overwrapping, pouching, and/or cartoning), and distribution.

Each of the vials comprising a multi-monodose container includes an internal volume. For example, the first vial and the second vial have an internal volume. In an aspect, the internal volume is configured to hold a pharmaceutical agent. For example, the internal volume can be sized to accommodate a single-dose volume of a pharmaceutical agent. For example, the first vial and the second vial of a multi-monodose container can each have an internal volume sufficient to hold a single-dose volume of a pharmaceutical agent. In an aspect, the single-dose volume of the pharmaceutical agent can be referred to in terms of milliliters (mL) or cubic centimeters (cc). In an aspect, the single-dose volume of a liquid pharmaceutical is configured for intramuscular, intradermal, subcutaneous, intravenous, or intraperitoneal injection. In an aspect, the single-dose volume of liquid pharmaceutical agent is configured for oral, nasal, otic, ocular, urethral, anal, or vaginal administration. In an aspect, the single-dose volume of liquid pharmaceutical is configured for intraocular injection. In an aspect, the single-dose volume of liquid pharmaceutical is configured for injection into the central nervous system, e.g., epidural administration.

In an aspect, the single-dose volume of the pharmaceutical agent is dependent upon the type of pharmaceutical agent. In an aspect, the single-dose volume of the pharmaceutical agent is a clinically-determined effective or therapeutic dose for that type of pharmaceutical agent. For example, recommended doses for common vaccines range from 0.05 mL for BCG (tuberculosis) vaccine to 1.0 mL for Hepatitis A vaccine to 2.0 mL for Rotavirus vaccine. In an aspect, the single-dose volume of the pharmaceutical agent is dependent upon the site of injection, e.g., intramuscular, subcutaneous, or intradermal. For example, a single dose volume of an intramuscular injection of a liquid pharmaceutical may be as great as 5 mL. See, e.g., Hopkins & Arias (2013) "Large volume IM injections: A review of best practices," *Oncology Nurse Advisor* January/February, which is incorporated herein by reference. In an aspect, the single-dose volume of the pharmaceutical agent is dependent upon the size of the individual who will be receiving the pharmaceutical agent. For example, the single-dose volume may be dependent upon the size, e.g., weight, of the intended recipient, e.g., a child versus an adult. For example, a single-dose volume for a subcutaneous injection of a pharmaceutical agent may be 0.5 mL, 1 mL, or 2 mL depending upon the size of the child or adult. In an aspect, the single-dose volume of the pharmaceutical agent ranges from about 0.01 mL to about 5 mL. For example, in some embodiments, the single-dose volume of the pharmaceutical agent can be 0.01 mL, 0.02 mL, 0.05 mL, 0.075 mL, 0.1 mL, 0.15 mL, 0.2 mL, 0.25 mL, 0.3 mL, 0.35 mL, 0.4 mL, 0.45 mL, 0.5 mL, 0.55 mL, 0.6 mL, 0.65 mL, 0.7 mL, 0.75 mL, 0.8 mL, 0.85 mL, 0.9 mL, 1.0 mL, 1.25 mL, 1.5 mL, 1.75 mL, 2.0 mL, 2.25 mL, 2.5 mL, 2.75 mL, 3.0 mL, 3.25 mL, 3.5 mL, 3.75 mL, 4.0 mL, 4.25 mL, 4.5 mL, 4.75 mL, or 5.0 mL.

In an aspect, the internal volume of each of the at least two vials of the multi-monodose container is sufficient to hold a single-dose volume of a pharmaceutical agent and a minimal overfill volume of the pharmaceutical agent. In an aspect, the internal volume is sufficient to hold a single-dose volume of a pharmaceutical agent, a minimal overfill volume of the pharmaceutical agent, and headspace above the pharmaceutical agent. For example, the internal volume of each of the vials comprising a multi-monodose container can be about 0.75 milliliters, a sufficient volume for a 0.5 milliliter single dose of a pharmaceutical agent, 0.1 milliliters of overfill, and 0.15 milliliters of headspace above the liquid pharmaceutical agent. In an aspect, the internal volume is about 0.2 milliliters to about 6.0 milliliters. For example, the internal volume of each of the vials of a multi-monodose container is 0.2 mL, 0.3 mL, 0.4 mL, 0.5 mL, 0.6 mL, 0.7 mL, 0.8 mL, 0.9 mL, 1.0 mL, 1.1 mL, 1.2 mL, 1.3 mL, 1.4 mL, 1.5 mL, 1.6 mL, 1.7 mL, 1.8 mL, 1.9 mL, 2.0 mL, 2.1 mL, 2.2 mL, 2.3 mL, 2.4 mL, 2.5 mL, 2.6 mL, 2.7 mL, 2.8 mL, 2.9 mL, 3.0 mL, 3.1 mL, 3.2 mL, 3.3 mL, 3.4 mL, 3.5 mL, 3.6 mL, 3.7 mL, 3.8 mL, 3.9 mL, 4.0 mL, 4.1 mL, 4.2 mL, 4.3 mL, 4.4 mL, 4.5 mL, 4.6 mL, 4.7 mL, 4.8 mL, 4.9 mL, 5.0 mL, 5.1 mL, 5.2 mL, 5.3 mL, 5.4 mL, 5.5 mL, 5.6 mL, 5.7 mL, 5.8 mL, 5.9 mL, or 6.0 mL.

In some embodiments, the internal volume of each of the vials of a multi-monodose container is greater than 6.0 milliliters. For example, the internal volume of each of the vials may be at least twice the volume of a single-dose volume of a pharmaceutical agent to accommodate two doses of the pharmaceutical agent. For example, the internal volume of each of the vials can be 10 milliliters and configured to hold two 3 milliliter single-dose volumes of the pharmaceutical agent.

Formation of a Multi-Monodose Container

In an aspect, a multi-monodose container such as described herein is formed using a molding manufacturing process. In an aspect, a multi-monodose container is formed using a blow molding manufacturing process. For example, the at least two vials and an articulating joint are formed by a blow molding manufacturing process. For example, the at least two vials and an articulating joint are formed by a blow-fill-seal manufacturing process. In an aspect, a multi-monodose container is formed using an injection molding manufacturing process. In an aspect, at least two vials and an articulating joint are formed by an injection molding manufacturing process. In an aspect, a multi-monodose container comprising a row of at least two vials and at least one articulating joint is formed from a biocompatible thermoplastic material using a blow molding manufacturing process or an injection molding manufacturing process or a blow-fill-seal manufacturing process.

In an aspect, the articulating joint is formed with the at least two vials. For example, the articulating joint connecting the first vial and the second vial is formed with the at least two vials. For example, mold for forming the multi-monodose container by a blow molding manufacturing process or an injection molding manufacturing process can include portions for forming the articulating joint connecting each of the at least two vials. In an aspect, each articulating joint extends the entire length of the adjacent vials. For example, the articulating joint can include a strip of flexible plastic extending along the entire length of the vials, including along the edge of removable caps. In an aspect, each articulating joint extends at least a portion of the length of the adjacent vials. For example, the articulating joint can include a strip of flexible plastic extending along the edge of just the body of the vials and not along the edge of the removable caps. In an aspect, each articulating joint is non-contiguous. For example, the articulating joint can include a series of non-contiguous flexible plastic portions connecting the edges of two adjacent vials.

In some embodiments, the articulating joint is formed separately from the at least two vials. For example, the articulating joint connecting the first vial and the second vial is formed separately from the at least two vials and is adapted for attachment to the at least two vials. For example, a series of articulating joints may be formed separately from a series of vials and adapted for attachment to the series of vials to form a row of interconnected vials.

In an aspect, a row of at least two vials and an articulating joint are formed by a blow molding manufacturing process. See, e.g., U.S. Pat. No. 3,325,860 to Hansen titled "Moulding and Sealing Machines," U.S. Pat. No. 3,936,264 to Cornett & Gaspar titled "Apparatus for Blow Molding a Container with Breachable Sealing Members," which is incorporated herein by reference. In an aspect, the blow molding manufacturing process includes at least the steps of melting a plastic resin, forming a hollow tube (parison) of molten plastic resin, clamping two halves of a mold around the hollow tube and holding it closed, expanding the parison into the mold cavity with compressed air by allowing the parison to take up the shape of mold cavity, and exhausting the air from the mold part and cooling the plastic resin. For example, pharmaceutical-grade plastic resin, e.g., polyethylene and/or polypropylene, can be heat extruded (vertically heat extruded) or injection molded to form a hanging vertical tube or hollow cylinder (parison). For example, granules of polyethylene and/or polypropylene can be fed into an extruder and melted at temperatures above 160 degrees centigrade. The extruded parison is enclosed by a two-part mold, sealing the lower end of the parison. The extruded parison is cut above the mold. The formed vials are allowed to cool and removed from the mold.

In an aspect, the multi-monodose container is formed, filled with a pharmaceutical agent, and sealed using a highly automated blow-fill-seal or form-fill-seal manufacturing process. For example, a multi-monodose container may be formed, filled with a pharmaceutical agent, and sealed using a process that includes at least the following steps: an aseptic solution including the pharmaceutic agent is delivered to the blow-fill-seal or form-fill-seal machine through a bacteria-retaining filter; sterile filtered compressed air and granules of a plastic material (e.g., polyethylene, polypropylene or polyethylene/polypropylene co-polymers) are supplied to the machine; the plastic granules are extruded downwards under pressure (e.g., up to 350 bar) as a hot hollow moldable plastic parison; two halves of a mold defining the outer surfaces of the multi-monodose container are closed around the parison to seal the base while the top of the parison is cut free by a hot knife-edge; the plastics material is formed into the multi-monodose container by vacuum and/or sterile air pressure; the formed multi-monodose containers are immediately filled with a metered volume of the solution including the pharmaceutical agent; once the required volume is filled into the vials of the multi-monodose container, the filling unit is raised and each of the vials are sealed automatically; the mold opens, releasing a multi-monodose container formed, filled and sealed in one continuous, automatic cycle. Machinery for use in a blow-fill-seal and/or form-fill-seal manufacturing process is available from commercial sources (from, e.g., Rommelag USA, Inc., Evergreen, Colo.; Weiler Engineering Inc., Elgin, Ill.).

In an aspect, the row of the at least two vials and the articulating joint are formed by an injection molding manufacturing process. For example, the row of the at least two vials and the articulating joint can be formed from a resin, e.g., a thermoplastic material, that is forced into an appropriately shaped mold by an injection ram or screw. Temperature and pressure are maintained until the thermoplastic material has hardened sufficiently for removal of the mold.

In an aspect, a multi-monodose container including the row of the at least two vials and the articulating joint is formed using one or more molds. In an aspect, the one or more molds are designed for blow mold manufacturing. For example, the mold can include two female parts which when closed form a cavity defining the outer surface of the multi-monodose container. In an aspect, the one or more molds are designed for injection mold manufacturing. For example, the mold can include a cavity into which a plastic polymer or resin is forced under pressure, the mold defining both the outer surface and the inner surface of the vials comprising the multi-monodose container. In an aspect, each of the one or more molds is formed from stainless steel or aluminum and is precision-machined to provide a mold for the external features and/or internal features of the multi-monodose container. Other non-limiting materials for use in forming molds for blow molding and/or infusion molding include beryllium, copper, aluminum, steel, chromium, nickel, stainless steel, and alloys thereof.

In an aspect, a multi-monodose container is formed from a biocompatible material. In an aspect, the row of the at least two vials and the articulating joint are formed from at least one biocompatible polymer. For example, the multi-monodose container can be formed from a material that is safe for use and compatible with the contents of the vials, e.g., a pharmaceutical agent in a dry or liquid form. For example, the biocompatible material, e.g., a biocompatible polymer or resin, is sufficiently inert as to prevent release or leaching of substances from the biocompatible material into the contents of the vials in quantities sufficient to affect the stability and/or safety of the pharmaceutical agent. For example, the biocompatible material is of a type that does not significantly absorb components of a dosage form, e.g., a pharmaceutical agent in a dry or liquid formulation, and/or does not allow the components of the pharmaceutical agent to migrate through the biocompatible material.

In an aspect, a multi-monodose container is formed from at least one thermoplastic material. For example, the multi-monodose container comprising at least two vials and at least one articulating joint can be formed from a heat pliable or moldable plastic polymer material. In an aspect, the row of the at least two vials and the articulating joint are formed from at least one thermoplastic material. For example, the row of the at least two vials and the articulating joint can be formed from at least one thermoplastic material, e.g., a heat pliable or moldable plastic polymer material, using blow molding or infusion molding manufacturing processes. Non-limiting examples of thermoplastic materials include ethylene-vinyl acetate, cyclic olefin copolymers, ionomer, fluorine-containing polymers, polyurethane, polyethylene terephthalate (PET), polyethylene terephthalate G (PETG), acrylics, cellulosics, poly(methyl methacrylate), acrylonitrile butadiene styrene, nylon, polylactic acid, polybenzimidazole, polycarbonate, polyether sulfone, polyetherether ketone, polyetherimide, polyethylene, polyphenylene oxide, polyphenylene sulfide, polypropylene, polystyrene, polyvinyl chloride, and polytetrafluoroethylene.

In an aspect, the at least one thermoplastic material includes a form of polyethylene. For example, the thermoplastic material can include a low density (LDPE) or branched form of polyethylene. For example, the thermoplastic material can include a high density (HDPE) or linear form of polyethylene. For example, the thermoplastic material can include a linear low density polyethylene (LLDPE), combining the clarity and density of LDPE and the toughness of HDPE.

In an aspect, the at least one thermoplastic material includes a form of polypropylene. For example, the thermoplastic material can include a highly crystalline form of polypropylene. For example, the thermoplastic material can include an isotactic form of polypropylene having organic groups on the same side of the polymer chain. For example, the thermoplastic material can include a higher impact form of polypropylene, e.g., syndiotactic with alternating organic groups above and below the polymer chain, or atactic with no regular sequence of organic side chains. In an aspect, polypropylene is modified with polyethylene or rubber to improve impact resistance, lower stiffness, and improve clarity.

In an aspect, a multi-monodose container is formed from glass using a blow molding or injection molding manufacturing process. For example, molten glass can be formed into vials using either a press-and-blow process or a blow-and-blow process. In both processes, the molten glass is pressed or blown into a parison and then blown into a mold defining the outer surface of the vial. In an aspect, the at least two vials are formed from borosilicate glass. For example, the at least two vials can be formed from Type I borosilicate glass. In an aspect, the articulating joint is formed with the at least two vials. In an aspect, the articulating joint is formed separately and subsequently attached to the at least two vials. For example, one or more articulating joints for use in connecting a row of glass vials can be formed from a flexible plastic resin subsequently attached to the glass vials.

In an aspect, the articulating joint is formed from a first material and the at least two vials are formed from a second material. For example, the articulating joint may be formed from a flexible plastic material while the at least two vials are formed from a more rigid plastic material. For example, the articulating joint may be formed from a flexible plastic material while the at least two vials are formed from glass.

In an aspect, a multi-monodose container is formed from a transparent material. For example, a multi-monodose container can be formed from a transparent material to permit a user to see the end of a needle, e.g., a syringe needle, in a vial comprising a part of the multi-monodose container. In an aspect, the multi-monodose container includes at least two vials and at least one articulating joint formed from a transparent material. For example, a row of at least two vials and an articulating joint can be formed from a transparent material using a blow molding manufacturing process or an infusion molding manufacturing process or a blow-fill-seal manufacturing process. In some embodiments, the transparent material includes glass. For example, the transparent material can include Type I borosilicate glass. In some embodiments, the transparent material includes a form of transparent thermoplastic material. For example, the transparent material can include a copolymer of vinyl acetate and ethylene. For example, the transparent material can include a low density form of polyethylene. For example, the transparent material can include polyvinyl chloride and in particular, unplasticized polyvinyl chloride. For example, the transparent material can include a cyclic olefin copolymer. See, e.g., U.S. Pat. No. 6,951,898 to Hammond and Heukelbach titled "Cycloolefin Copolymer Resins Having Improved Optical Properties," which is incorporated herein by reference.

In some embodiments, a multi-monodose container is formed from a translucent material. For example, a row of at least two vials and an articulating joint can be formed from a translucent material using a blow molding manufacturing process or an infusion molding manufacturing process or a blow-fill-seal manufacturing process.

In an aspect, a multi-monodose container is formed from an opaque material. In an aspect, the row of the at least two vials and the articulating joint are formed from an opaque material. For example, a row of at least two vials and an articulating joint can be formed from an opaque material using a blow molding manufacturing process or an infusion molding manufacturing process or a blow-fill-seal manufacturing process. For example, the at least two vials and the articulating joint of the multi-monodose container can be formed from an opaque plastic, e.g., a high density polyethylene.

In an aspect, a multi-monodose container is formed from a tinted material. In an aspect, the row of the at least two vials and the articulating joint are formed from a tinted material. For example, the at least two vials of the multi-monodose container are formed from a tinted material, e.g., amber-colored glass or thermoplastic, that limits that amount of light or ultraviolet radiation that can pass through the vials. For example, the multi-monodose container can be formed from an extruded thermoplastic material that includes color masterbatch, dyes, or pigments configured to impart color, e.g., an amber color, to the vials.

In an aspect, one or more additives are included in the material forming the multi-monodose container. For example, the one or more additives can include lubricants, stabilizers, antioxidants, plasticizers, antistatic agents, or slip agents. In an aspect, the process of forming the multi-monodose container includes the addition of one or more of a lubricant, a stabilizer, an antioxidant, a plasticizer, an antistatic agent, a slip agent, or a combination thereof. For example, one or more lubricants may be used during the molding or extrusion process to facilitate flow of the molten thermoplastic on the metal surfaces of the mold. A non-limiting example of a lubricant for this purpose includes zinc stearate. For example, one or more stabilizers may be added to the thermoplastic to retard or prevent degradation of the polymer by heat, light, and/or ultraviolet exposure during the manufacturing process as well as to improve the aging characteristics of the thermoplastic. Non-limiting examples of stabilizers for this purpose include organometallic compounds, fatty acid salts, and inorganic oxides. For example, one or more anti-oxidants to inhibit formation of free radicals may be added to the thermoplastic to retard oxidation-induced degradation of the thermoplastic. Non-limiting examples of anti-oxidants for this purpose include aromatic amines, hindered phenolics, thioesters, and phosphites. For example, one or more plasticizers may be added to the thermoplastic to achieve softness, flexibility, and melt flow during processing. A non-limiting example of a plasticizer for this purpose includes a phthalate, e.g., dioctyl phthalate. For example, one or more antistatic agents may be used to prevent the buildup of static charges on the plastic surfaces. For example, one or more slip agents may be added to the thermoplastic material to reduce the coefficient of friction of the material. A non-limiting example of a slip agent for use with polyethylene and/or polypropylene thermoplastics includes polyolefins. In an aspect, a surface treatment is applied to the outer surfaces of the multi-monodose container. For example, the surface treatment can include corona discharge or deposition of thin layers of other plastics to improve such properties as ink adherence, adherence to other films, heat sealability, or gas barrier.

Closure

In an aspect, each of the at least two vials of a multi-monodose container includes a tapered neck region and an access portion. For example, the tapered neck region can include a tapered extension of the four walls forming a vial ending in an access portion, i.e., opening, for accessing the internal volume of the vial. In an aspect, the tapered neck region is circular in horizontal cross-section. For example, the tapered neck region may include a tapered tube attached to the body of a vial that is otherwise polygonal in horizontal cross-section. In an aspect, the tapered neck region is oval in horizontal cross-section. In an aspect, the tapered neck region is polygonal in horizontal cross-section. In an aspect, the tapered neck region has a horizontal cross-section that is similar to that of the body of the vial. In an aspect, the tapered neck region ends with a flared rim. In an aspect, the tapered neck region ends with an annular lip. For example, the tapered neck region can include a flared rim or annular lip for use in securing a cover or cap, e.g., a needle-penetrable septum, with a crimp seal. See, e.g., U.S. Pat. No. 3,424,329 to Hershberg et al. titled "Sealed Injection Vial," which is incorporated herein by reference.

In an aspect, the access portion comprises an aperture defined by the walls of a vial. In an aspect, the access portion is contiguous with the internal volume of the vial. For example, the access portion can include an aperture or opening defined by the end of the walls forming the vial that allows access to the internal volume of the vial. For example, the access portion includes an opening in a vial for access to the pharmaceutical agent held within. For example, the access portion is sufficiently large enough to accommodate passage of a needle, e.g., a syringe needle.

In an aspect, a multi-monodose container comprising at least two vials and an articulating joint includes a closure covering an access portion. In an aspect, each of the at least two vials includes a closure covering an access portion. In an aspect, the closure comprises an integral part of the vial. For example, the closure may include a sealed portion formed by fusing or heat sealing the walls at an open end of a vial to cover the access portion. In an aspect, the sealed portion includes a needle-penetrable closure. For example, a sealed portion formed by fusing or heat sealing the walls at an open end of a vial may further be needle-penetrable to allow a needle to pass through the sealed portion to access the internal volume of the vial.

In an aspect, the closure comprises a removable cap. In an aspect, the removable cap includes a shearable cap. For example, a shearable cap can be formed during the blow-fill-seal manufacturing process in such a way as to be readily shearable from the remainder of the vial upon use to reveal the access portion. In an aspect, the removable cap includes a twistable cap. For example, a twistable cap can be formed during the blow-fill-seal manufacturing process in such a way as to be readily twistable from the remainder of the vial upon use to reveal the access portion. In an aspect, the removable cap is formed from a second molding process after formation of the base of the vials and at least a portion of the articulating joint. In an aspect, the removable cap is an insert added during the molding process. See, e.g., U.S. Pat. No. 3,993,223 to Welker & Brady titled "Dispensing Container;" U.S. Pat. No. 6,626,308 to Weiler titled "Hermetically Sealed Container with Self-Draining Closure," U.S. Pat. No. 4,319,701 to Cambio titled "Blow Molded Container Having an Insert Molded In Situ," all of which are incorporated herein by reference.

In an aspect, the closure comprises a needle-penetrable closure. In an aspect, the needle-penetrable closure is configured to allow passage of a needle into the internal volume of a vial through a needle-penetrable material forming at least a portion of the multi-monodose container. For example, the closure can include a needle-penetrable portion of the thermoplastic material used to form the multi-monodose container. For example, the top of a blow-fill-sealed vial can include a needle-penetrable closure. For example, each of the vials forming the multi-monodose container can include a removable cap that once removed uncovers a needle-penetrable closure.

In an aspect, the closure comprises an additional part added to each of the vials. In an aspect, the closure comprises an insert. For example, the closure can include an insert that is added to the blow-molded or injection-molded vial. For example, the closure can include a removable cap that is added to the blow-molded or injection-molded vial. For example, the closure can include an insert that is added during the molding process. See, e.g., U.S. Pat. No. 4,319,701 to Cambio titled "Blow Molded Container Having an Insert Molded In Situ," which is incorporated herein by reference. In an aspect, the closure includes at least in part another sterile component that is added to each of the vials.

For example, the insert can include a tip-type cap, a metal component, or a Luer taper fitting. In an aspect, the insert is attached to the multi-monodose container during the manufacturing process. In an aspect, the insert comprises a co-molded tip-and-cap insert for generating a calibrated drop, a multi-entry elastomeric stopper insert, or a controlled-diameter injection-molded insert. In an aspect, the closure comprises a septum. For example, insertion technology can be used to incorporate a sterile tip and cap insert into the blow-fill-seal formed multi-monodose container.

In an aspect, the access portion includes a Luer taper connector or fitting. For example, the access portion of a vial can include a Luer taper connector appropriately sized to mate with a syringe including a Luer lock or Luer slip tip, allowing for the removal of the contents of the vial without the use of a syringe needle. See, e.g., U.S. Pat. No. 4,643,309 to Evers & Lakemedel titled "Filled Unit Dose Container," which is incorporated herein by reference.

In an aspect, the closure includes an elastomeric closure. For example, the closure can include a needle-penetrable elastomeric septum, e.g., a rubber septum, inserted into the access portion and held in place with an aluminum seal crimped around a tapered neck region of the vial. For example, the elastomeric closure is formed from bromobutyl or chlorobutyl synthetic rubber. In an aspect, the elastomeric closure is further protected with a plastic flip-off cap.

Pharmaceutical Agents

In an aspect, each of the at least two vials of the multi-monodose container includes an internal volume configured to hold a pharmaceutical agent. In an aspect, the internal volume is configured to hold at least a single-dose volume of a pharmaceutical agent. In an aspect, the internal volume is configured to hold one or more doses of a pharmaceutical agent. For example, each of the vials of a multi-monodose container can be configured to hold a single-dose volume of a pharmaceutical agent. For example, each of the vials of a multi-monodose container can be configured to hold two or more single-dose volumes of a pharmaceutical agent.

In an aspect, the pharmaceutical agent is formulated for parenteral or oral administration. In an aspect, the pharmaceutical agent is in a liquid form. For example, the pharmaceutical agent can be dissolved or suspended in a liquid formulation appropriate for oral or parenteral administration. In an aspect, the pharmaceutical agent can be in a powdered form intended to be reconstituted with a liquid. For example, the pharmaceutical agent can be in a lyophilized form intended to be reconstituted, e.g., with sterile diluent or water-for-injection, prior to administration.

In an aspect, the pharmaceutical agent is a preventative agent, e.g., an agent capable of preventing a medical condition or infectious disease. In an aspect, the pharmaceutical agent comprises a vaccine. For example, the pharmaceutical agent can include a vaccine or vaccines capable of eliciting or conferring immunity against or preventing infection by one or more infectious agents. In an aspect, the pharmaceutical agent includes at least one vaccine configured for immunization against one or more infectious agent, disease, or condition, non-limiting examples of which include anthrax, tuberculosis (BCG), cholera, Dengue fever, diphtheria, tetanus, pertussis, haemorrhagic fever, haemophilus b (Hib), hepatitis A, hepatitis B, human papillomavirus, influenza, Japanese encephalitis, malaria, measles, meningococcal meningitis, mumps, poliovirus, rubella, varicella virus, plague, Streptococcus pneumoniae, rabies, Rift Valley fever, rotavirus, rabies, rubella, smallpox, tick-borne encephalitis, typhoid, yellow fever, and shingles (Zoster). In an aspect, the pharmaceutical agent includes two or more vaccines. For example, the pharmaceutical agent can include the DPT vaccine including vaccines against diphtheria, tetanus, and pertussis.

In some embodiments, a multi-monodose container is configured for the transport and storage of a specific number of individual doses of multiple pharmaceutical agents intended for use for a single patient within a limited time period, such as a single medical clinic visit. For example, in some embodiments a multi-monodose container includes the vaccines suggested to be administered to a child of a particular age at a well-child visit to a medical clinic. For example, in some embodiments a multi-monodose container including four vials can store four doses of four different vaccines which are generally administered to an individual during a single medical visit. For example, in some embodiments a multi-monodose container including six vials is configured for the storage and transport of a single dose of each of the HepB, RV, DTaP, HiB, PCV, and IPV vaccines, one in each of the vials, for administration to a child according to the routine vaccine schedule suggested for 2 month olds. For example, in some embodiments a multi-monodose container including four vials is configured for the storage and transport of a single dose of each of the DTaP, IPV, MMR and VAR vaccines, one in each vial, for administration to a child according to the routine vaccine schedule suggested for 4-6 year olds. See "Advisory Committee on Immunization Practices (ACIP) Recommended Immunization Schedule for Persons Aged 0 through 18 years—United States, 2013" ACIP Childhood/Adolescent Work Group, *MMWR* 62: 1-8 (2013), which is incorporated herein by reference.

In an aspect, the pharmaceutical agent includes an immunoglobulin therapy. In an aspect, a multi-monodose container is configured to store multiple doses of an immunoglobulin therapy to be administered in a series to a patient as directed by a medical professional. Several types of immunoglobulin therapy are available that are generally administered serially, in dose volumes relative to the body mass of a patient. Aliquot volumes of an immunoglobulin therapy can be stored in individual vials of a multi-monodose container, in a form to minimize waste of the immunoglobulin therapy as well as to minimize the potential of contamination of the immunoglobulin therapy in the vials.

In an aspect, the pharmaceutical agent includes at least one of an anti-viral agent, an antibiotic, or a biological agent. For example, in some embodiments a multi-monodose container can be used to store multiple doses of an injection-administered anti-viral therapy. For example, in some embodiments a multi-monodose container is configured to store multiple doses of injection-administered antibiotic therapy. For example, in some embodiments a multi-monodose container is configured to store doses of biologicals that include therapeutic proteins. For example, in some embodiments a multi-monodose container is configured to store doses of biologicals that include antibodies, such as monoclonal or polyclonal antibodies. For example, in some embodiments a multi-monodose container is configured to store multiple doses of an injection-administered therapy generally administered to a single patient in series, so that the multi-monodose container can include a standard series of injectable doses for a single individual patient to be administered in temporal series under the guidance of a medical professional. For example, in some embodiments a multi-monodose container is configured to store doses of an injection-administered therapy that has multiple components that are administered separately, for example different antibiotics and/or antivirals that are administered to a single patient in need thereof.

In an aspect, the pharmaceutical agent is a therapeutic agent. For example, the pharmaceutical agent can include a drug or medicament capable of treating a medical condition. Non-limiting examples of therapeutic agents include antibiotics, e.g., penicillin, cefuroxime, ceftazidime; interferons, e.g., interferon alpha, beta, or gamma; peripheral vasodilators, e.g., alprostadil; anticoagulants, e.g., fondapainux; gonadotrophins, e.g., follitropin; anabolic hormones, e.g., somatropin; bone formation agents, e.g., teriparatide; HIV drugs, e.g., enfuvirtide; contraceptives, e.g., medroxyprogesterone acetate; anti-inflammatory agents, e.g., etanercept, adalimumab; serotonin receptor antagonists, e.g., sumatriptan; GRH analogs, e.g., leuprolide; chemotherapies, insulin, hormones, anti-infectives, and the like.

In an aspect, the pharmaceutical agent includes an active ingredient. In an aspect, the active ingredient includes one or more vaccines. In an aspect, the active ingredient includes one or more therapeutic agents. In some embodiments, the pharmaceutical agent includes additional inactive ingredients, e.g., excipients, configured to preserve, stabilize, or otherwise protect the active ingredient in the pharmaceutical agent. Non-limiting examples of inactive ingredients or excipients include solvents or co-solvents, e.g., water or propylene glycol, buffers, anti-microbial preservatives, antioxidants, or wetting agents, e.g., polysorbates or poloxamers. Other non-limiting examples of inactive ingredients or excipients include trace residual material resulting from manufacturing the active ingredient, e.g., neomycin or formalin.

In an aspect, each of the vials forming the multi-monodose container is configured to hold an inert gas. For example, each of the vials may be configured to hold an inert gas in the headspace above the pharmaceutical agent. For example, each of the vials may be configured to hold nitrogen in the headspace above the pharmaceutical agent. For example, each of the vials may be configured to hold a noble gas, e.g., argon, neon, krypton, or xenon, in the headspace above the pharmaceutical agent. For example, each of the vials may be configured to hold carbon dioxide in the headspace above the pharmaceutical agent. The process of forming, filling, and sealing the vials of the multi-monodose container may further include purging the atmospheric air/oxygen in the headspace prior to adding an inert gas.

In an aspect, a multi-monodose container is configured to form an expanded configuration and configured to form a folded configuration. In an aspect, the multi-monodose container includes at least two vials and an articulating joint, wherein the articulating joint is sufficiently flexible to reversibly mate one of at least two planar outer surfaces of a first vial with one of at least two planar outer surfaces of a second vial. In an aspect, the at least two vials and the articulating joint are configured to form an expanded configuration and configured to form a folded configuration. In an aspect, a first vial, at least one second vial, and at least one articulating joint are configured to form an expanded configuration and configured to form a folded configuration. In an aspect, the folded configuration comprises the one of the at least two planar outer surfaces of the first vial parallel to the one of the at least two planar outer surfaces of the second vial. In an aspect, the expanded configuration has a first rectangular packing cross-sectional area and the folded configuration has a second rectangular packing cross-sectional area. In an aspect, the second rectangular packing cross-sectional area is smaller than the first rectangular packing cross-sectional area.

Figure 9A:
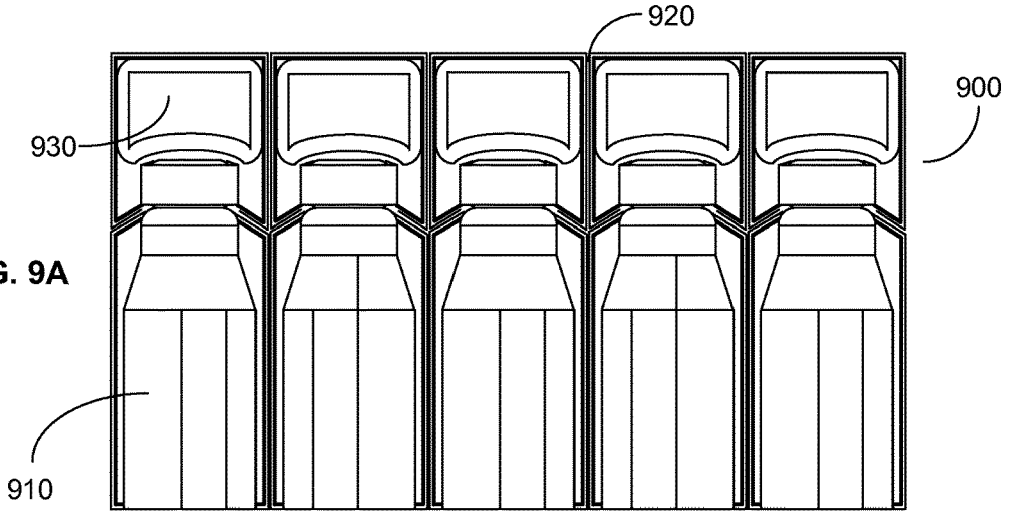
FIG. 9A is a side view a multi-monodose container in an expanded configuration.
Figure 9B:
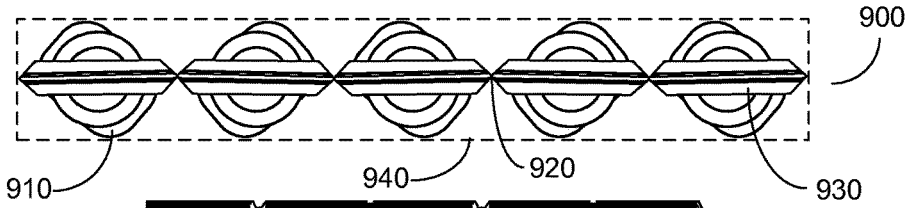
FIG. 9B is a top-down view of a multi-monodose container in an expanded configuration with a first rectangular packing cross-sectional area.
Figure 9C:
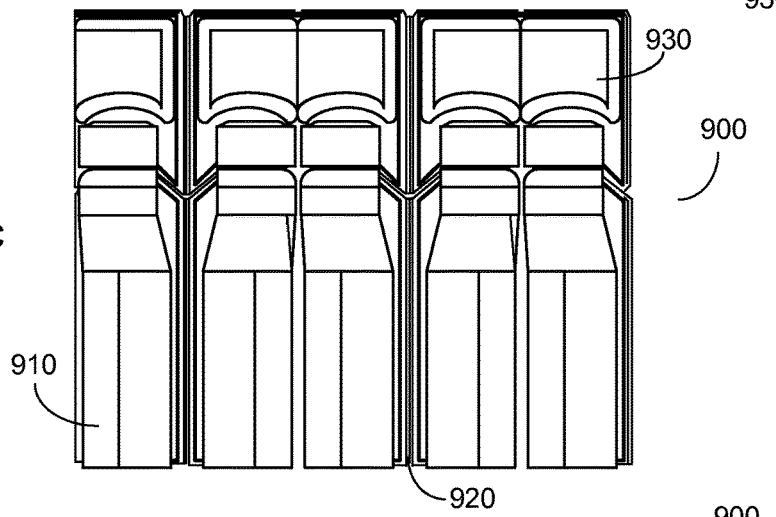
FIG. 9C is a side view of a multi-monodose container in a folded configuration.
Figure 9D:
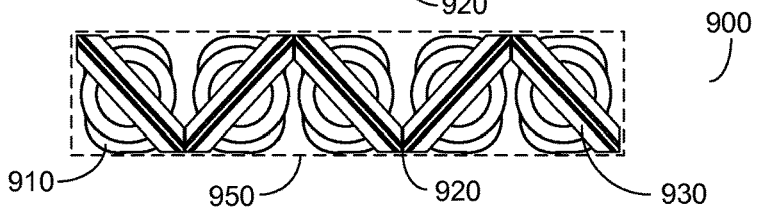
FIG. 9D is a top-down view of a multi-monodose container in a folded configuration with a second rectangular packing cross-sectional area.
Figure 9E:
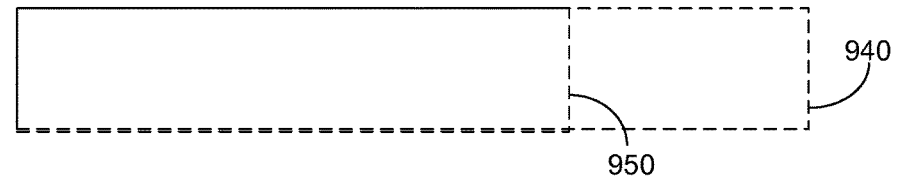
FIG. 9E is a comparison of the first rectangular packing cross-sectional area of FIG. 9B and the second rectangular packing cross-sectional area of FIG. 9D.

FIGS. 9A-9E illustrate aspects of a multi-monodose container in an expanded configuration and a folded configuration. FIG. 9A is an illustration of a side-view of a multi-monodose container 900 in an expanded configuration. In this non-limiting example, multi-monodose container 900 includes five vials 910 connected to one another through articulating joint 920. Each of the five vials 910 includes a removable cap 930. FIG. 9B is a top-down view of multi-monodose container 900, including five vials 910 connected to one another through articulating joints 920. Each of the five vials is substantially rectangular in horizontal cross-section. Also shown is a top view of removable cap 930. Multi-monodose container 900 in an expanded configuration has a first rectangular packing cross-sectional area 940 (dotted line). FIG. 9C is an illustration of a side-view of multi-monodose container 900 in a folded configuration. Multi-monodose container 900 includes five vials 910 connected to one another through articulating joint 920. Each of the five vials 910 includes a removable cap 930. FIG. 9D is a top-down view of multi-monodose container 900 in the folded configuration and includes five vials 910 connected to one another through articulating joint 920. Also shown is a top view of removable cap 930. Multi-monodose container 900 in a folded configuration has a second rectangular packing cross-sectional area 950 (dotted line). FIG. 9E illustrates the overlap between first rectangular packing cross-sectional area 940 and second rectangular packing cross-sectional area 950. In an aspect, the second rectangular packing cross-sectional area 950 is smaller than the first rectangular packing cross-sectional area 940.

In some embodiments, a multi-monodose container includes a row of at least two vials, a first vial connected to an adjacent second vial through an articulating joint, the articulating joint sufficiently flexible to reversibly mate a planar outer surface of the first vial with a planar outer surface of the adjacent second vial, wherein the row of the at least two vials is configured to form a first rectangular packing cross-sectional area in an expanded configuration and configured to form a second rectangular packing cross-sectional area in a folded configuration, the second rectangular packing cross-sectional area smaller than the first rectangular packing cross-sectional area.

Figure 10A:
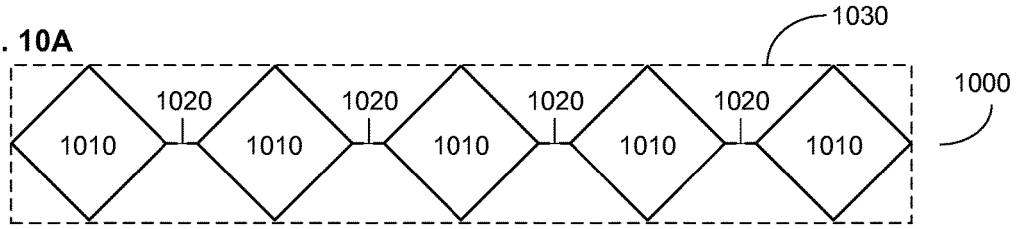
FIG. 10A is a top-down view of a schematic of a multi-monodose container in an expanded configuration with a first rectangular packing cross-sectional area.
Figure 10B:
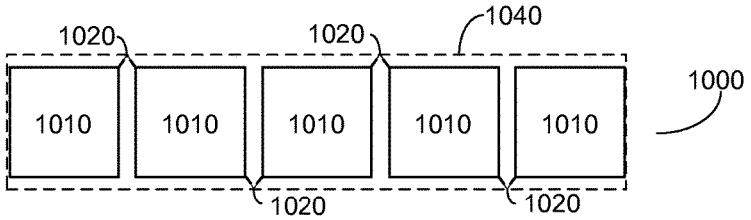
FIG. 10B is a top-down view of a schematic of a multi-monodose container in a folded configuration with a second rectangular packing cross-sectional area.
Figure 10C:
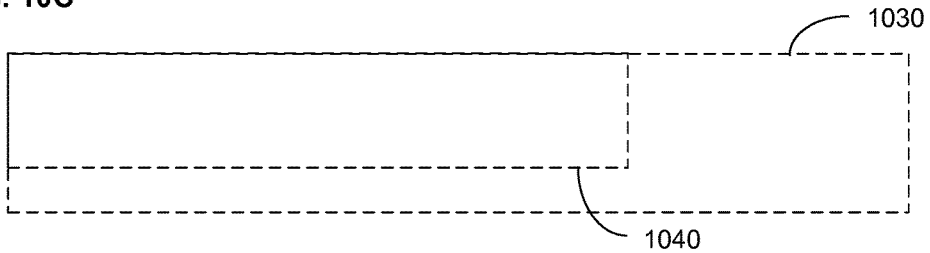
FIG. 10C is a comparison of the first rectangular packing cross-sectional area of FIG. 10A and the second rectangular packing cross-sectional area of FIG. 10B.

FIGS. 10A-10C illustrate further aspects of a multi-monodose container including a row of at least two vials. FIG. 10A is a top-down view of multi-monodose container 1000 in an expanded configuration. In this non-limiting example, multi-monodose container 1000 includes five vials 1010 interconnected through articulating joints 1020. For example, a vial 1010 is connected to an adjacent vial 1010 through an articulating joint 1020. In this non-limiting example, each of the five vials 1010 is substantially square in horizontal cross-section. The row of vials 1010 comprising multi-monodose container 1000 is configured to form a first rectangular packing cross-sectional area 1030 (dotted line) in the expanded configuration. FIG. 10B is a top-down view of multi-monodose container 1000 in a folded configuration. Multi-monodose container 1000 includes five vials 1010 interconnected through bent articulating joints 1020. The articulating joints 1020 are sufficiently flexible to reversibly mate a planar outer surface of vial 1010 with a planar outer surface of an adjacent vial 1010. The row of vials comprising multi-monodose container 1000 is configured to form a second rectangular packing cross-sectional area 1040 (dotted line) in the folded configuration. FIG. 10C is an overlay of the first rectangular packing cross-sectional area 1030 of multi-monodose container 1000 in the expanded configuration and the second rectangular packing cross-sectional area 1040 of multi-monodose container 1000 in the folded configuration. The second rectangular packing cross-sectional area 1040 is smaller than the first rectangular packing cross-sectional area 1030.

Figure 11A:
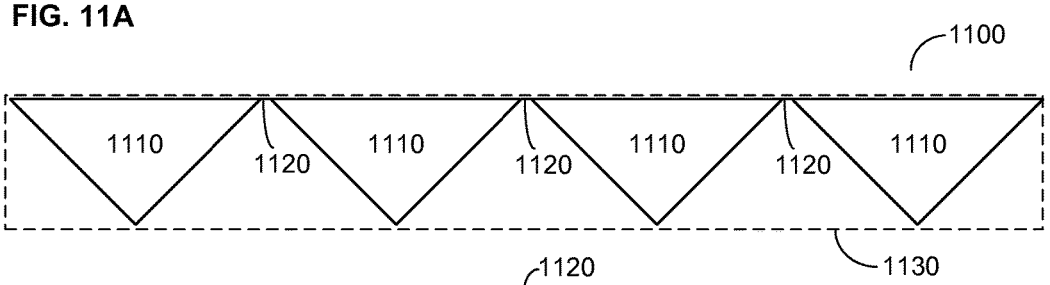
FIG. 11A is a top-down view of a schematic of a multi-monodose container in an expanded configuration with a first rectangular packing cross-sectional area.
Figure 11B:
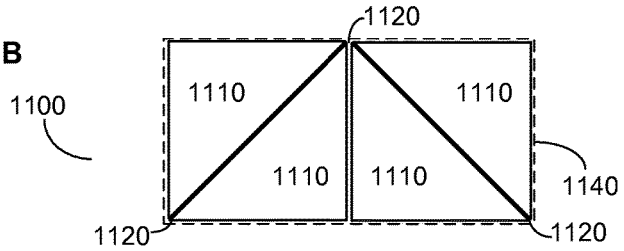
FIG. 11B is a top-down view of a schematic of a multi-monodose container in a folded configuration with a second rectangular packing cross-sectional area.
Figure 11C:
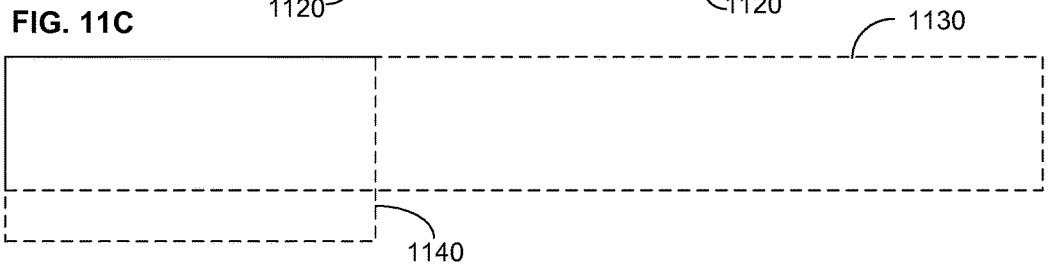
FIG. 11C is a comparison of the first rectangular packing cross-sectional area of FIG. 11A and the second rectangular packing cross-sectional area of FIG. 11B.

FIGS. 11A-11C illustrate further aspects of a multi-monodose container in an expanded configuration and a folded configuration. FIG. 11A is a top-down view of multi-monodose container 1100 in an expanded configuration. In this non-limiting example, multi-monodose container 1100 includes four vials 1110 interconnected through articulating joint 1120. In this non-limiting example, each of the four vials 1110 is substantially triangular in horizontal cross-section. Multi-monodose container 1100 has a first rectangular packing cross-sectional area 1130 (dotted line) in the expanded configuration. FIG. 11B is a top-down view of multi-monodose container 1100 in a folded configuration. Multi-monodose container 1100 includes four vials 1110 interconnected through bent articulating joints 1120. Multi-monodose container 1100 has a second rectangular packing cross-sectional area 1140 (dotted line) in the folded configuration. FIG. 11C is an overlay of the first rectangular packing cross-sectional area 1130 with the second rectangular packing cross-sectional area 1140. The second rectangular packing cross-sectional area 1140 of the multi-monodose container 1100 in the folded configuration is smaller than the first rectangular packing cross-sectional area 1130 of the multi-monodose container 1100 in the expanded configuration.

In an aspect, the row of the at least two vials includes at least one pair of reversibly mating planar outer surfaces and at least one pair of non-mating planar outer surfaces, the row of the at least two vials in the folded configuration including the at least one pair of reversibly mating planar outer surfaces parallel to one another and the at least one pair of non-mating planar outer surfaces forming a substantially planar outer surface of the row of the at least two vials.

In an aspect, a multi-monodose container includes a row of at least two vials interconnected by at least one articulating joint, the row of at least two vials including at least one pair of reversibly mating planar outer surfaces and at least one pair of non-mating planar outer surfaces, the row of at least two vials configured to form an expanded configuration and configured to form a folded configuration, the folded configuration including the at least one pair of reversibly mating planar outer surfaces parallel to one another and the at least one pair of non-mating planar outer surfaces forming a substantially planar outer surface of the row of at least two vials.

Labeling

In an aspect, a multi-monodose container includes a label. The label includes information regarding the pharmaceutical agent contained within each of the at least two vials forming the multi-monodose container. For example, the label can include the proprietary name of the pharmaceutical agent, the established name or proper name of the pharmaceutical agent, the generic name of the pharmaceutical agent, a product logo or other branding, strength of the pharmaceutical agent, route(s) of administration, warnings (if any), cautionary statements (if any), net quantity, manufacturer name, expiration date, lot number, recommended storage conditions, recommended single dose volume (if multiple doses per vial), a bar code, a batch number, national drug code numbers, controlled substance schedule information (if applicable), radio frequency identification (RFID) tag, or combinations thereof. For a pharmaceutical agent in liquid form, the label may include the strength per total volume (e.g., 500 mg/10 mL), the strength per milliliter (e.g., 50 mg/1 mL), and/or the strength per recommended dosage volume. For a pharmaceutical agent in powder form, the label may include the amount of pharmaceutical agent (e.g., in milligrams) per vial. The label may also include instructions for reconstituting a pharmaceutical agent that is in powder form and the strength of the pharmaceutical agent in the reconstituted volume. For additional information regarding container labels see, e.g., Guidance for Industry: Safety Considerations for Container Labels and Carton Labeling Design to Minimize Medication Errors," Food and Drug Administration, April 2013, which is incorporated herein by reference.

In an aspect, the multi-monodose container includes more than one label. For example, in some embodiments each of the vials comprising the multi-monodose container has an individual label. In an aspect, the label is printed on an outer surface of at least one of the at least two vials comprising the multi-monodose container. For example, the label, or portions thereof, may be printed onto at least one surface of the multi-monodose container using thermal transfer overprinting, laser marking system, continuous inkjet, or thermal inkjet. In an aspect, the label is printed on an outer surface of each of the vials comprising the multi-monodose container. For example, the label can be printed on one or more of the planar outer surfaces of a vial. For example, the label can be printed on a portion of a removable cap associated with the vial.

In an aspect, the label includes embossed lettering raised on an outer surface of at least one of the at least two vials comprising the multi-monodose container. In an aspect, the label includes debossed lettering engraved on an outer surface of at least one of the at least two vials comprising the multi-monodose container. For example, the label or a portion thereof may be incorporated into the molds used for at least one of blow molding, infusion molding, or blow-fill-seal manufacturing to generate either raised or engraved lettering that includes at least a portion of the labeling information. For example, the label or a portion thereof may be engraved onto an outer surface of at least one of the at least two vials comprising the multi-monodose container following manufacturing.

In an aspect, the label is stamped onto at least one surface of a multi-monodose container. For example, in some embodiments, a label is stamped on an outer surface of at least one of the at least two vials comprising the multi-monodose container. For example, in some embodiments, a label is stamped on a portion of a closure, e.g., a removable cap or tab. In some embodiments, the label is stamped using an ink. In some embodiments, the label is stamped using a hot stamping process. For example, the labeling information can be incorporated into a metal die which when heated and placed on a surface of a thermoplastic multi-monodose container transfers the labeling information to the multi-monodose container. In an aspect, the labeling information stamped on an outer surface of at least one of the at least two vials comprising the multi-monodose container includes lot-specific information, e.g., a product lot number and/or an expiry date.

In an aspect, the label is attached to at least one of the at least two vials comprising the multi-monodose vial. In an aspect, the label is attached to each of the at least two vials comprising the multi-monodose vials. For example, the label can be attached to one or more of the planar outer surfaces of a vial. For example, the label can be attached to a removable cap associated with the vial. In an aspect, the label is printed separately and includes an adhesive for adhering at least a portion of the label to at least one surface of the multi-monodose container. For example, labels can be printed separately and attached with an adhesive to the removable cap of each of the vials comprising the multi-monodose container. For example, the label can be printed separately onto a tag that includes a pressure sensitive adhesive. For example, the label can be printed separately onto a tag that is adhered to each of the vials comprising the multi-monodose container with a separate piece of pressure sensitive adhesive, e.g., a piece of clear adhesive tape.

In an aspect, the label includes a foldable label. For example, in some embodiments the multi-monodose container includes a foldable label attached to one portion of the multi-monodose container and configured to fold over or around a second portion of the multi-monodose container. For example, a foldable label can be attached to a twistable cap or tab and configured to be folded down along one of the planar outer surfaces of a vial. For example, a foldable label can be attached to one of the planar outer surfaces of a vial and configured to be folded around at least a portion of a vial. In an aspect, a foldable label is attached to at least one of at least two vials comprising a multi-monodose container before enclosing the multi-monodose container in a sealable covering, e.g., a foil overwrap. In an aspect, the foldable label includes a larger surface area for providing legible product labeling information while reducing the packing volume of the sealed multi-monodose container.

In an aspect, the label includes a single perforated master label attached to the multi-monodose container. In an aspect, the label includes a single perforated master label attached to each of at least two vials comprising the multi-monodose container. For example, in some embodiments a single label including perforations is attached to each of the at least two vials of a multi-monodose container and positioned such that separation of the vials from one another also separates the single label into sub-labels along the perforation lines. In some embodiments, the single perforated master label includes a single copy of the labeling information. In some embodiments, each of the separable portions of the single perforated master label includes a copy of the labeling information.

In an aspect, the label includes at least one sensor. In an aspect, the multi-monodose container includes at least one label with at least one sensor. For example, the multi-monodose container can include a label with a sensor configured to detect or monitor an environmental exposure of the multi-monodose container. For example, the multi-monodose container can include a label with a sensor configured to detect or monitor an environmental exposure to the multi-monodose container as a result of a breach in secondary packaging. In an aspect, each of the vials comprising the multi-monodose container includes a label with at least one sensor. For example, each of the vials comprising a multi-monodose container can include a label with a sensor configured to detect or monitor exposure of each of the vials to an environmental condition, e.g., temperature, light, moisture, or oxygen. For example, the label can include at least one sensor configured to detect or monitor an environmental exposure as a result of a breach in secondary packaging, e.g., a sealed covering.

In an aspect, a label including at least one sensor includes a foldable label including at least one sensor. For example, at least one of the at least two vials comprising a multi-monodose container can include a foldable label with a sensor, the placement of the sensor such that folding the label brings the sensor in physical contact with an outer surface of the at least one of the at least two vials comprising the multi-monodose container.

In an aspect, the at least one sensor includes at least one temperature sensor. In an aspect, the at least one sensor is configured to monitor a temperature excursion, e.g., a transport or storage temperature that is outside a recommended range for a given pharmaceutical agent. For example, the at least one sensor can include a temperature sensor configured to monitor whether or not the multi-monodose container and/or the individual vials and potentially heat-sensitive pharmaceutical agents are exposed to excessive heat during transport and/or storage. For example, the at least one sensor can include a chemical composition that instantaneously and irreversibly changes in color in response to one or more temperature excursions. For example, the at least one sensor can include a chemical composition that gradually and irreversibly changes in color in response to one or more temperature excursions. In an aspect, the at least one sensor includes a substrate, e.g., a paper laminate, with an indicator dye. In an aspect, the indicator dye is configured to change color in response to changes in temperature. In an aspect, the change in color is irreversible. See, e.g., U.S. Pat. No. 5,085,802 to Jalinski titled "Time Temperature Indicator with Distinct End Point;" U.S. Pat. No. 5,254,473 to Patel titled "Solid State Device for Monitoring Integral Values of Time and Temperature of Storage of Perishables;" and U.S. Pat. No. 6,544,925 to Prusik et al. titled "Activatable Time-Temperature Indicator System," which are incorporated herein by reference. In an aspect, the at least one sensor includes a temperature sensor configured to monitor cumulative heat exposure. For example, the at least one sensor can include a HEATmarker® indicator (from Temptime Corporation, Morris Plains, N.J.) which gradually changes color in response to cumulative heat exposure. For example, the at least sensor can include a Timestrip PLUS Duo for cumulative detection of temperature excursions above or below a specified threshold (from Timestrip, United Kingdom). In an aspect, the at least one sensor includes a temperature sensor configured to detect a threshold or limit temperature level. For example, the at least one sensor can include a LIMIT-marker™ indicator (from Temptime Corporation, Morris Plains, N.J.) or a 3M™ MonitorMark™ Time Temperature Indicator (from 3M, St. Paul, Minn.) which irreversibly changes color if the label and the contents therein have been exposed to a potentially damaging threshold temperature. In an aspect, the at least one sensor includes a temperature sensor configured to monitor whether or not the multi-monodose container and/or its freeze-sensitive contents are exposed to inappropriate freezing temperatures during transport and/or storage. For example, the at least one sensor can include a FREEZEmarker® indicator (from Temptime Corporation, Morris Plains, N.J.) or a 3M™ Freeze Watch™ indicator (from 3M, St. Paul, Minn.) which irreversibly changes color in response to a freeze event. See, e.g., Kartoglu & Milstien (2014) "Tools and approached to ensure quality of vaccines throughout the cold chain," Expert Rev. Vaccines 13: 843-854, which is incorporated herein by reference. Other time-temperature indicators include VITSAB®, CheckPoint® (from Vitsab International, Sweden), Fresh-Check®

In an aspect, the label includes a vaccine vial monitor (VVM) to indicate the cumulative heat exposure of a vial of vaccine to determine whether the cumulative heat history of the product has exceeded a pre-set limit. In an aspect, the vaccine vial monitor includes at least one of a VVM30, a VVM14, a VVM7, or a VVM2 indicator depending upon the heat stability of the product. For example, a VVM30 label has a 30 day end point at 37° C. and greater than 4 years end point at 5° C. while a VVM2 label has a 2 day end point at 37° C. and a 225 day end point at 5° C. For more information regarding international specifications for vaccine vial monitors, see Vaccine Vial Monitor, PQS performance specification, World Health Organization, WHO/PQS/E06/IN05.2 issued on Jul. 26, 2011, which is incorporated herein by reference.

In an aspect, the at least one sensor includes a light sensor. For example, the at least one sensor can include a light sensor configured to monitor whether the multi-monodose container and/or the individual vials comprising the multi-monodose container has been exposed to light. For example, the multi-monodose container may be protected from damaging light or ultraviolet exposure with a secondary packaging, e.g., in non-transparent sealed packaging. A light sensor may be used to detect a potential breach in the secondary packaging covering/sealing a multi-monodose container. For example, the light sensor can include a photoresistor, light-dependent resistor, or photocell associated with a readable radiofrequency identification (RFID) tag. For example, the light sensor can include a light harvesting photovoltaic module (from, e.g., ElectricFilm, LLC, Newburyport, Mass.).

In an aspect, the at least one sensor includes an oxygen sensor. For example, the multi-monodose container can include at least one label with an oxygen sensor configured to determine whether a nitrogen or argon vacuum sealed secondary packaging has been breached prior to use. In an aspect, the oxygen indicator is a luminescence-based oxygen indicator. For example, the oxygen sensor can include tris(4,7-diphenyl-1,10-phenanthroline) perchlorate, i.e. [Ru(dpp)3](ClO4)2 encapsulated in a ease-permeable material, e.g., silicone rubber. Luminescence associated with [Ru(dpp)3](ClO4)2 is quenched in the presence of oxygen. For example, the oxygen sensor can include O2xyDot™ oxygen sensors (from OxySense® Dallas, Tex.) attached to the label and/or the vial. In an aspect, the oxygen indicator is a colorimetric indicator configured to change color in response to exposure to oxygen. For example, the oxygen sensor can include a colorimetric redox dye-based indicator, e.g., Ageless Eye™ (from Mitsubishi Gas Company, Japan). In an aspect, the oxygen sensor includes a colorimetric light-activated, redox dye-based oxygen indicator. For example, the oxygen sensor can include a photoexcited dye that is "primed" with ultraviolet or visible light and further changes color in response to oxygen exposure. See, e.g., Mills (2005) "Oxygen indicators and intelligent inks for packaging food," Chem. Soc. Rev. 34:1003-1011, which is incorporated herein by reference. U.S. Pat. No. 8,707,766 to Harris et al. titled "Leak detection in vacuum bags," which is incorporated herein by reference. U.S. Pat. No. 8,501,100 to Fukui titled "Oxygen detection using metalloporphyrins," which is incorporated herein by reference.

In an aspect, the label includes at least one water vapor sensor or other moisture sensor. For example, the label can include a sensor configured to detect exposure to moisture as a result of a breach in secondary packaging covering/sealing a multi-monodose container. For example, the at least one moisture sensor can include a colorimetric water detection label which changes color in response to exposure to moisture (e.g., 3M™ Ultrathin Water Contact Indicator from 3M Company, St. Paul, Minn.). Also see, e.g., U.S. Pat. No. 4,098,120 to Manske titled "Humidity Indicating Method and Device," which is incorporated herein by reference.

Additional information regarding colorimetric packaging sensors is described in Kamal el Deen (2013) "The Intelligent Colorimetric Timer Indicator Systems to Develop Label Packaging Industry in Egypt" Int. Design J. 4:295-304.

In an aspect, the label includes electronics. In an aspect, the label includes XpressPDF temperature monitoring labels (from PakSense, Boise, Id.) which includes a built in USB connection point and generates a PDF data file containing complete time and temperature history. In an aspect, the label includes printed electronics. For example, the label includes a printed radiofrequency identification tag. For example, the label can include a printed temperature sensor using ThinFilm technology (from, e.g., Thin Film Electronics ASA, Oslo, Norway).

In an aspect, the label includes a smart radiofrequency identification (RFID) tag. For example, the RFID tag can be integrated with sensors, e.g., temperature and/or light sensors, for wireless monitoring of environmental conditions. See, e.g., Cho et al. (2005) "A 5.1-W UHF RFID Tag Chip integrated with Sensors for Wireless Environmental Monitoring," Proceedings of ESSCIRC, Grenoble, France, 2005, pp. 279-282, which is incorporated herein by reference.

Multi-Monodose Container with Beveled Edges

A multi-monodose container includes at least two vials including a first vial having at least two planar outer surfaces defining a first edge therebetween and a second vial having at least two planar outer surfaces defining a second edge therebetween. In some embodiments, at least one of the first edge and the second edge comprises a beveled edge. In some embodiments, at least one of the first edge and the second edge comprises a double-beveled edge. In some embodiments, a multi-monodose container includes at least two vials including a first vial having a first double-beveled edge adjacent to at least two planar outer surfaces, a second vial having a second double-beveled edge adjacent to at least two planar outer surfaces, an articulating joint connecting the first double-beveled edge and the second double-beveled edge, wherein the articulating joint is sufficiently flexible to reversibly mate one of the at least two planar outer surface of the first vial with one of the at least two planar outer surfaces of the second vial.

In an aspect, the articulating joint is sufficiently flexible to reversibly mate a beveled surface of the double beveled edge of the first edge with a beveled surface of the double-beveled edge of the second edge. In an aspect, the first edge of the first vial comprises a first double-beveled edge and the second edge of the second vial includes a second double-beveled edge, the articulating joint connecting the first double-beveled edge and the second double-beveled edge, wherein the articulating joint is sufficiently flexible to reversibly mate a beveled surface of the first double-beveled edge with a beveled surface of the second double-beveled edge.

In some embodiments, a multi-monodose container includes at least two vials including a first vial having a first double-beveled edge adjacent to at least two planar outer surfaces, a second vial having a second double-beveled edge adjacent to at least two planar outer surfaces, an articulating joint connecting the first double-beveled edge and the second double-beveled edge, wherein the articulating joint is sufficiently flexible to reversibly mate a beveled surface of the first double-beveled edge of the first vial with a beveled surface of the second double-beveled edge of the second vial.

FIGS. 12A-12D illustrate aspects of a multi-monodose container including at least two vials with at least one beveled-edge. FIG. 12A is a top-down view of a horizontal cross-section through multi-monodose container 1200. Multi-monodose container 1200 is shown in an expanded configuration. Multi-monodose container 1200 includes first vial 1205, second vial 1210, and third vial 1215. Each of first vial 1205, second vial 1210, and third vial 1215 includes at least one double-beveled edge 1220. In this non-limiting example, each vial includes two double-beveled edges diagonally opposed to one another. A double-beveled edge 1220 of first vial 1205 is connected to a double-beveled edge 1220 of second vial 1210 through articulating joint 1225 (encompassed within dotted line box 1240). Similarly, third vial 1215 is connected to a second double-beveled edge of second vial 1210 though a second articulating joint. Each of the double-beveled edges 1220 is adjacent to a first planar outer surface 1230 and a second planar outer surface 1235. FIG. 12B is an enlargement of dotted line box 1240 illustrating the double-beveled edges. Shown is a double-beveled edge 1220 of first vial 1205 connected to double-beveled edge 1220 of second vial 1210 through articulating joint 1225. Also shown are portions of first planar outer surface 1230 and second planar outer surface 1235.

Articulating joint 1225 is sufficiently flexible to reversibly mate a planar outer surface of a first vial with a planar outer surface of a second vial. This is exemplified in FIGS. 12C and 12D. FIG. 12C is a top-down view of a horizontal cross-section through multi-monodose container 1200 in a folded configuration. Multi-monodose container 1200 includes first vial 1205, second vial 1210, and third vial 1215. First vial 1205, second vial 1210, and third vial 1215 are connected in series through articulating joints 1225. In this non-limiting example, each of the vials includes two double-beveled edges. Also shown is a dotted line triangle 1250 encompassing an example of a bent articulating joint 1225 and associated double-beveled edges. FIG. 12D is an enlargement of the contents of dotted line triangle 1250. In this enlargement of a bent articulating joint, a double-beveled edge 1220 of first vial 1205 is connected to a double-beveled edge 1220 of second vial 1210 through articulating joint 1225. Articulating joint 1225 is sufficiently flexible to reversibly mate a second planar outer surface 1235 of the first vial 1205 with a second planar outer surface 1235 of the second vial 1210. In an aspect, the second planar outer surfaces 1235 of first vial 1205 and second vial 1210 are a reversibly mating pair of planar outer surfaces. In an aspect, each planar outer surface of the reversibly mating pair of planar outer surfaces is parallel to the other planar outer surface of the reversibly mating pair. In an aspect, first planar outer surfaces 1230 of first vial 1205 and second vial 1210 form non-mating planar outer surface. In some embodiments, the articulating joint 1225 is sufficiently flexible to reversibly mate a beveled surface 1260 of first vial 1205 and a beveled surface 1260 of second vial 1210. In an aspect, the beveled surface 1260 of first vial 1205 and the beveled surface 1260 of second vial 1210 form a reversibly mating pair of beveled surfaces.

Sealable Covering

In some embodiments, a multi-monodose container includes a sealable covering. For example, a multi-monodose container including a pharmaceutical agent stored therein includes secondary packaging, or integrated primary packaging configured to cover and seal the multi-monodose container. In an aspect, the sealable covering is configured to protect the multi-monodose container from at least one of light exposure, ultraviolet radiation, vapor permeation, or oxygen or other gaseous ingress. For example, the multi-monodose container can be placed in an opaque sealable covering intended to protect the multi-monodose container and its contents from light exposure or UV radiation. For example, the multi-monodose container can be placed in sealable container configured to prevent vapor permeation (i.e., either permeation of the pharmaceutical agent through the container or external liquid or vapor permeating into the container). For example, the multi-monodose container can be placed in a suitable packaging material and all but a fraction of the air removed from the packaging material prior to sealing. In some embodiments, residual air in the sealable covering is replaced with an inert gas, e.g., nitrogen or argon.

In some embodiments, the sealable covering is formed separately from the multi-monodose container. In some embodiments, the sealable covering is formed as part of the multi-monodose container. For example, when forming the multi-monodose container using blow molding or blow-fill-seal manufacturing, the hot parison itself can include multiple layers of material that provide an interior container wall (made of material X), a middle layer (made of material Y), and an external sealing layer (made of material Z).

In an aspect, the sealable covering includes a shrink film. Non-limiting examples of shrink film include polyolefin, polyvinyl chloride, polyethylene, or polypropylene. In an aspect, the shrink film includes a multi-layer film. For example, the shrink film can include a multi-layered film including layers of ethylene-propylene, ethylene-vinyl acetate, and polyester. In an aspect, the shrink film includes an embedded light barrier. For example, in some embodiments, the shrink film can include the addition of masterbatch or some other pigment or dye type that renders the sealable covering opaque and protecting the covered/sealed multi-monodose container within from light and/or UV exposure.

In an aspect, the sealable covering includes a flexible foil laminate. For example, the vacuum sealable covering can include an aluminum barrier foil laminate. In an aspect, the sealable covering includes a metallized polymer film. For example, the metallized polymer film can include a polymer film, e.g., a polyethylene terephthalate, polypropylene, nylon, polyethylene, or ethylene vinyl alcohol (EVOH) film, coated with a thin layer of metal, e.g., aluminum, gold, nickel, and/or chromium. For example, the sealable covering can include a metal coated Mylar.

In an aspect, the sealable covering is sealed under vacuum. For example, a shrink film or flexible foil laminate covering one or more multi-monodose containers may be sealed under vacuum, optionally in the presence of an inert gas. In an aspect, the sealable covering is sealed under positive pressure. For example, a shrink film or flexible foil laminate covering one or more multi-monodose containers may be sealed under nitrogen-purged positive pressure. In an aspect, the sealable covering is sealed under zero or near-zero pressure (e.g., neither vacuum nor positive-pressure).

In an aspect, the sealable covering holds the at least two vials and the articulating joint in a folded configuration. In an aspect, the sealable covering holds the row of at least two vials and the articulating joint in the folded configuration. In an aspect, the multi-monodose container is in the folded configuration prior to placing the multi-monodose container into the sealable covering. In an aspect, the multi-monodose container is configured to fold into the folded configuration during the process of sealing the sealable covering. For example, the multi-monodose container can be configured to fold into the folded configuration during sealing of the sealable covering under vacuum.

In an aspect, each multi-monodose container includes a sealable covering. For example, a single multi-monodose container including two or more interconnected vials includes a sealable covering. In an aspect, the single multi-monodose container is sealed in the sealable covering in a folded configuration. In an aspect, two or more multi-monodose containers are included in a single sealable covering. For example, two or more multi-monodose containers, each having two or more interconnected vials, are sealed in a single sealable covering. In an aspect, each of the multi-monodose containers is sealed in the single sealable covering in a folded configuration.

In an aspect, each of at least two vials comprising a multi-monodose container is individually sealed in a sealable covering. In an aspect, the sealable covering covering/sealing each of the at least two vials comprising the multi-monodose container includes perforations between the vials. For example, each of the at least two vials comprising the multi-monodose container can include a sealable covering that includes a line of perforations allowing for separation of one vial from an adjacent vial without compromising the air-tight seal of the sealable covering. In an aspect, at least a portion of a sealable covering covering/sealing a single vial of a multi-monodose container is attached to at least a portion of the single vial. For example, at least a portion of the sealable covering can be glued to the single vial. In an aspect, at least a portion of a sealable covering covering/sealing a single vial of a multi-monodose container is melded to at least a portion of the single vial. For example, at least a portion of the sealable covering can be heat sealed to at least a portion of the single vial.

In an aspect, the sealable covering is configured to hold an inert gas. For example, the sealable covering can be configured to hold an inert gas upon sealing the sealable covering. For example, the sealable covering can be configured to hold nitrogen. For example, the sealable covering can be configured to hold another inert gas, e.g., neon, argon, krypton, or xenon. For example, the sealable covering can be configured to hold carbon dioxide. In an aspect, the process of sealing at least one multi-monodose container in the sealable covering includes purging atmospheric air/oxygen from sealable covering prior to adding an inert gas, e.g., nitrogen, neon, argon, krypton, xenon, or carbon dioxide. In an aspect, the multi-monodose container includes a label with an oxygen sensor configured to detect a breach in the sealable covering.

In an aspect, the sealable covering includes a label. For example, a label or a portion thereof is included on secondary packaging covering or sealing a multi-monodose container. The label can include a paper label affixed to the sealable covering, printed label, or a stamped label. In some embodiments, the sealable covering (e.g., foil pouching) includes a label capturing all of the product labeling information requirements. In some embodiments, a multi-monodose container includes embossing/debossing, stamping, and or paper labeling in addition to labeling associated with secondary packaging (e.g., sealed foil pouch) and tertiary packaging (e.g., a cardboard carton).

One skilled in the art will recognize that the herein described component, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, devices, and objects should not be taken as limiting.

With respect to the use of substantially any plural and/or singular terms herein, the plural can be translated to the singular and/or from the singular to the plural as is appropriate to the context and/or application. The various singular/plural permutations are not expressly set forth herein for sake of clarity.

In some instances, one or more components can be referred to herein as "configured to," "configured by," "configurable to," "operable/operative to," "adapted/adaptable," "able to," "conformable/conformed to," etc. Those skilled in the art will recognize that such terms (e.g. "configured to") can generally encompass active-state components and/or inactive-state components and/or standby-state components, unless context requires otherwise.

While particular aspects of the present subject matter described herein have been shown and described, changes and modifications can be made without departing from the subject matter described herein and its broader aspects and, therefore, the appended claims are to encompass within their scope all such changes and modifications as are within the true spirit and scope of the subject matter described herein. Terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). If a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). Typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

Aspects of the subject matter described herein are set out in the following numbered paragraphs:

1. In some embodiments, a multi-monodose container includes at least two vials including a first vial having at least two planar outer surfaces defining a first edge therebetween; a second vial having at least two planar outer surfaces defining a second edge therebetween; an articulating joint connecting the first edge and the second edge; wherein the articulating joint is sufficiently flexible to reversibly mate one of the at least two planar outer surfaces of the first vial with one of the at least two planar outer surfaces of the second vial.

2. The multi-monodose container of paragraph 1, wherein the at least two vials and the articulating joint are formed by a blow molding manufacturing process.

3. The multi-monodose container of paragraph 1, wherein the at least two vials and the articulating joint are formed by an injection molding manufacturing process.

4. The multi-monodose container of paragraph 1, wherein the at least two vials and the articulating joint are formed by a blow-fill-seal manufacturing process.

5. The multi-monodose container of paragraph 1, wherein the at least two vials and the articulating joint are formed from at least one biocompatible polymer.

6. The multi-monodose container of paragraph 1, wherein the at least two vials and the articulating joint are formed from at least one thermoplastic material.

7. The multi-monodose container of paragraph 1, wherein the at least two vials and the articulating joint are formed from a transparent material.

8. The multi-monodose container of paragraph 1, wherein the at least two vials and the articulating joint are formed from an opaque material.

9. The multi-monodose container of paragraph 1, wherein the at least two vials and the articulating joint are formed from a tinted material.

10. The multi-monodose container of paragraph 1, wherein the at least two vials are square in horizontal cross-section.

11. The multi-monodose container of paragraph 1, wherein the at least two vials are triangular in horizontal cross-section.

12. The multi-monodose container of paragraph 1, wherein the at least two vials are hexagonal in horizontal cross-section.

13. The multi-monodose container of paragraph 1, wherein the at least two vials are polygonal in horizontal cross-section.

14. The multi-monodose container of paragraph 1, wherein each of the at least two vials has an internal volume configured to hold a pharmaceutical agent.

15. The multi-monodose container of paragraph 14, wherein the internal volume is about 1.0 milliliter.

16. The multi-monodose container of paragraph 14, wherein the internal volume is about 0.2 milliliter to about 10 milliliters.

17. The multi-monodose container of paragraph 14, wherein the pharmaceutical agent comprises a vaccine.

18. The multi-monodose container of paragraph 14, wherein the pharmaceutical agent comprises a therapeutic agent.

19. The multi-monodose container of paragraph 1, wherein the articulating joint connecting the first vial and the second vial is formed with the at least two vials.

20. The multi-monodose container of paragraph 1, wherein the articulating joint connecting the first vial and the second vial is formed separately from the at least two vials and is adapted for attachment to the at least two vials.

21. The multi-monodose container of paragraph 1, wherein the articulating joint connecting the first vial and the second vial is cleavable.

22. The multi-monodose container of paragraph 1, further comprising at least one third vial and at least one additional articulating joint.

23. The multi-monodose container of paragraph 1, wherein the at least two vials comprises two vials, three vials, four vials, five vials, six vials, seven vials, eight vials, nine vials, or ten vials.

24. The multi-monodose container of paragraph 1, wherein at least one of the first edge and the second edge comprises a beveled edge.

25. The multi-monodose container of paragraph 1, wherein at least one of the first edge and the second edge comprises a double-beveled edge.

26. The multi-monodose container of paragraph 25, wherein the articulating joint is sufficiently flexible to reversibly mate a beveled surface of the double-beveled edge of the first edge with a beveled surface of the double-beveled edge of the second edge.

27. The multi-monodose container of paragraph 1, wherein the first edge of the first vial comprises a first double-beveled edge and the second edge of the second vial includes a second double-beveled edge, the articulating joint connecting the first double-beveled edge and the second double-beveled edge, wherein the articulating joint is sufficiently flexible to reversibly mate a beveled surface of the first double-beveled edge with a beveled surface of the second double-beveled edge.

28. The multi-monodose container of paragraph 1, wherein each of the at least two vials includes a tapered neck region and an access portion.

29. The multi-monodose container of paragraph 1, wherein each of the at least two vials includes a closure covering an access portion.

30. The multi-monodose container of paragraph 29, wherein the closure comprises a needle-penetrable closure 31. The multi-monodose container of paragraph 29, wherein the closure comprises a removable cap.

32. The multi-monodose container of paragraph 31, wherein the removable cap comprises a shearable cap.

33. The multi-monodose container of paragraph 31, wherein the removable cap comprises a twistable cap.

34. The multi-monodose container of paragraph 29, wherein the closure comprises an insert.

35. The multi-monodose container of paragraph 34, wherein the insert comprises a co-molded tip-and-cap insert, a elastomeric stopper insert, or a controlled-diameter injection-molded insert.

36. The multi-monodose container of paragraph 1, further including a label associated with at least one of the at least two vials.

37. The multi-monodose container of paragraph 36, wherein the label is printed on an outer surface of the at least one of the at least two vials.

38. The multi-monodose container of paragraph 36, wherein the label is adhered to an outer surface of the at least one of the at least two vials.

39. The multi-monodose container of paragraph 36, wherein the label includes at least one sensor.

40. The multi-monodose container of paragraph 39, wherein the at least one sensor includes at least one temperature sensor.

41. The multi-monodose container of paragraph 39, wherein the at least one sensor includes at least one light sensor.

42. The multi-monodose container of paragraph 39, wherein the at least one sensor includes at least one oxygen sensor.

43. The multi-monodose container of paragraph 1, wherein the at least two vials and the articulating joint are configured to form an expanded configuration and configured to form a folded configuration.

44. The multi-monodose container of paragraph 43, wherein the folded configuration comprises the one of the at least two planar outer surfaces of the first vial parallel to the one of the at least two planar outer surfaces of the second vial.

45. The multi-monodose container of paragraph 43, wherein the expanded configuration has a first rectangular packing cross-sectional area and the folded configuration has a second rectangular packing cross-sectional area.

46. The multi-monodose container of paragraph 45, wherein the second rectangular packing cross-sectional area is smaller than the first rectangular packing cross-sectional area.

47. The multi-monodose container of paragraph 1, further including a sealable covering.

48. The multi-monodose container of paragraph 47, wherein the sealable covering holds the at least two vials and the articulating joint in a folded configuration.

49. In some embodiments, a multi-monodose container includes a row of at least two vials, a first vial connected to an adjacent second vial through an articulating joint, the articulating joint sufficiently flexible to reversibly mate a planar outer surface of the first vial with a planar outer surface of the adjacent second vial, wherein the row of the at least two vials is configured to form a first rectangular packing cross-sectional area in an expanded configuration and configured to form a second rectangular packing cross-sectional area in a folded configuration, the second rectangular packing cross-sectional area smaller than the first rectangular packing cross-sectional area.

50. The multi-monodose container of paragraph 49, wherein the row of the at least two vials includes at least one pair of reversibly mating planar outer surfaces and at least one pair of non-mating planar outer surfaces, the row of the at least two vials in the folded configuration including the at least one pair of reversibly mating planar outer surfaces parallel to one another and the at least one pair of non-mating planar outer surfaces forming a substantially planar outer surface of the row of the at least two vials.

51. The multi-monodose container of paragraph 49, wherein the row of the at least two vials is formed by a blow molding manufacturing process.

52. The multi-monodose container of paragraph 49, wherein the row of the at least two vials is formed by an injection molding manufacturing process.

53. The multi-monodose container of paragraph 49, wherein the row of the at least two vials is formed by a blow-fill-seal manufacturing process.

54. The multi-monodose container of paragraph 49, wherein the row of the at least two vials is formed from at least one biocompatible polymer.

55. The multi-monodose container of paragraph 49, wherein the row of the at least two vials is formed from at least one thermoplastic material.

56. The multi-monodose container of paragraph 49, wherein the row of the at least two vials is formed from a transparent material.

57. The multi-monodose container of paragraph 49, wherein the row of the at least two vials is formed from an opaque material.

58. The multi-monodose container of paragraph 49, wherein the row of the at least two vials is formed from a tinted material.

59. The multi-monodose container of paragraph 49, wherein at least one of the at least two vials is square in horizontal cross-section.

60. The multi-monodose container of paragraph 49, wherein at least one of the at least two vials is triangular in horizontal cross-section.

61. The multi-monodose container of paragraph 49, wherein at least one of the at least two vials is hexagonal in horizontal cross-section.

62. The multi-monodose container of paragraph 49, wherein at least one of the at least two vials is polygonal in horizontal cross-section.

63. The multi-monodose container of paragraph 49, wherein each of the at least two vials has an internal volume configured to hold a pharmaceutical agent.

64. The multi-monodose container of paragraph 63, wherein the internal volume is about 1.0 milliliter.

65. The multi-monodose container of paragraph 63, wherein the internal volume is about 0.2 milliliter to about 10 milliliters.

66. The multi-monodose container of paragraph 49, wherein the pharmaceutical agent comprises a vaccine.

67. The multi-monodose container of paragraph 49, wherein the pharmaceutical agent comprises a therapeutic agent.

68. The multi-monodose container of paragraph 49, wherein the articulating joint is cleavable.

69. The multi-monodose container of paragraph 49, wherein the at least two vials comprises two vials, three vials, four vials, five vials, six vials, seven vials, eight vials, nine vials, or ten vials.

70. The multi-monodose container of paragraph 49, wherein each of the at least two vials includes a tapered neck region and an access portion.

71. The multi-monodose container of paragraph 49, wherein each of the at least two vials includes a closure covering an access portion.

72. The multi-monodose container of paragraph 71, wherein the closure comprises at least one of a needle-penetrable closure, a shearable closure, or a twistable closure.

73. The multi-monodose container of paragraph 71, wherein the closure comprises an insert.

74. The multi-monodose container of paragraph 73, wherein the insert comprises a co-molded tip-and-cap insert, a elastomeric stopper insert, or a controlled-diameter injection-molded insert.

75. The multi-monodose container of paragraph 49, further comprising a label associated with at least one of the at least two vials.

76. The multi-monodose container of paragraph 75, wherein the label is printed on an outer surface of the at least one of the at least two vials.

77. The multi-monodose container of paragraph 75, wherein the label is adhered to an outer surface of the at least one of the at least two vials.

78. The multi-monodose container of paragraph 75, wherein the label includes at least one sensor.

79. The multi-monodose container of paragraph 78, wherein the at least one sensor includes at least one of a temperature sensor, a light sensor, or an oxygen sensor.

80. The multi-monodose container of paragraph 49, further including a sealable covering.

81. The multi-monodose container of paragraph 80, wherein the sealable covering holds the row of the at least two vials in the folded configuration.

82. In some embodiments, a multi-monodose container includes a row of at least two vials interconnected by at least one articulating joint, the row of at least two vials including at least one pair of reversibly mating planar outer surfaces and at least one pair of non-mating planar outer surfaces, the row of at least two vials configured to form an expanded configuration and configured to form a folded configuration, the folded configuration including the at least one pair of reversibly mating planar outer surfaces parallel to one another and the at least one pair of non-mating planar outer surfaces forming a substantially planar outer surface of the row of at least two vials.

83. In some embodiments, a multi-monodose container includes a row of at least two vials, each of the at least two vials having four walls connected to a rectangular base to define an internal volume, each of the four walls including a planar outer surface, a first planar outer surface and a second planar outer surface defining a first edge therebetween, the second planar outer surface and a third planar outer surface defining a second edge therebetween, the third planar outer surface and a fourth planar outer surface defining a third edge therebetween, and the fourth planar outer surface and the first planar outer surface defining a fourth edge therebetween; an articulating joint connecting the third edge of a first vial to the first edge of a second vial, the articulating joint sufficiently flexible to reversibly mate the first or the second planar outer surface of the second vial with the third or fourth planar outer surface of the first vial; the row of the at least two vials configured to form a first rectangular packing cross-sectional area in an expanded configuration and configured to form a second rectangular packing cross-sectional area in a folded configuration, the second rectangular packing cross-sectional area smaller than the first rectangular packing cross-sectional area.

84. The multi-monodose container of paragraph 83, wherein the row of the at least two vials is formed through a blow molding manufacturing process.

85. The multi-monodose container of paragraph 83, wherein the row of the at least two vials is formed through an injection molding manufacturing process.

86. The multi-monodose container of paragraph 83, wherein the row of the at least two vials is formed through a blow-fill-seal manufacturing process.

87. The multi-monodose container of paragraph 83, wherein the row of the at least two vials is formed from at least one thermoplastic material.

88. The multi-monodose container of paragraph 83, wherein the row of the at least two vials is formed from a transparent material.

89. The multi-monodose container of paragraph 83, wherein the row of the at least two vials is formed from an opaque material.

90. The multi-monodose container of paragraph 83, wherein the row of the at least two vials is formed from a tinted material.

91. The multi-monodose container of paragraph 83, wherein each of the at least two vials is polygonal in horizontal cross-section.

92. The multi-monodose container of paragraph 83, wherein each of the at least two vials is square in horizontal cross-section.

93. The multi-monodose container of paragraph 83, wherein each of the at least two vials is triangular in horizontal cross-section.

94. The multi-monodose container of paragraph 83, wherein each of the at least two vials is hexagonal in horizontal cross-section.

95. The multi-monodose container of paragraph 83, wherein the internal volume is about 0.5 milliliters.

96. The multi-monodose container of paragraph 83, wherein the internal volume is about 0.1 to about 3.0 milliliters.

97. The multi-monodose container of paragraph 83, wherein the internal volume is configured to hold a pharmaceutical agent.

98. The multi-monodose container of paragraph 97, wherein the pharmaceutical agent comprises a vaccine.

99. The multi-monodose container of paragraph 97, wherein the pharmaceutical agent comprises a therapeutic agent.

100. The multi-monodose container of paragraph 83, wherein the articulating joint is sufficiently flexible to reversibly mate the first planar outer surface of the second vial to the fourth planar outer surface of the first vial.

101. The multi-monodose container of paragraph 83, wherein the articulating joint is sufficiently flexible to reversibly mate the second planar outer surface of the second vial to the third planar outer surface of the first vial.

102. The multi-monodose container of paragraph 83, wherein the articulating joint is cleavable.

103. The multi-monodose container of paragraph 83, further including two or more vials and at least one additional articulating joint.

104. The multi-monodose container of paragraph 83, wherein the at least two vials comprises two vials, three vials, four vials, five vials, six vials, seven vials, eight vials, nine vials, or ten vials.

105. The multi-monodose container of paragraph 83, wherein at least one of the first edge, the second edge, the third edge, and the fourth edge of each of the at least two vials comprises a beveled edge.

106. The multi-monodose container of paragraph 83, wherein at least one of the first edge, the second edge, the third edge, and the fourth edge of each of the at least two vials comprises a double-beveled edge.

107. The multi-monodose container of paragraph 106, wherein the double-beveled edge includes a beveled surface.

108. The multi-monodose container of paragraph 107, wherein the first vial includes a first double-beveled edge and the second vial includes a second double-beveled edge, the articulating joint connecting the first double-beveled edge to the second double-beveled edge, the articulating joint sufficiently flexible to reversibly mate the beveled surface of the first double-beveled edge of the first vial with the beveled surface of the second double-beveled edge of the second vial.

109. The multi-monodose container of paragraph 83, wherein the third edge of the first vial comprises a first double-beveled edge and the first edge of the second vial includes a second double-beveled edge, the articulating joint connecting the first double-beveled edge of the first vial and the second double-beveled edge of the second vial, wherein the articulating joint is sufficiently flexible to reversibly mate a beveled surface of the first double-beveled edge with a beveled surface of the second double-beveled edge.

110. The multi-monodose container of paragraph 83, wherein at least one of the at least two vials includes a tapered neck region and an access portion.

111. The multi-monodose container of paragraph 83, wherein each of the at least two vials includes a closure covering an access portion.

112. The multi-monodose container of paragraph 111, wherein the closure comprises a needle-penetrable closure 113. The multi-monodose container of paragraph 111, wherein the closure comprises a removable cap.

114. The multi-monodose container of paragraph 113, wherein the removable cap comprises a shearable cap.

115. The multi-monodose container of paragraph 113, wherein the removable cap comprises a twistable cap.

116. The multi-monodose container of paragraph 111, wherein the closure comprises an insert.

117. The multi-monodose container of paragraph 116, wherein the insert comprises a co-molded tip-and-cap insert, a elastomeric stopper insert, or a controlled-diameter injection-molded insert.

118. The multi-monodose container of paragraph 83, further including a label associated with at least one of the at least two vials.

119. The multi-monodose container of paragraph 118, wherein the label is printed on an outer surface of the at least one of the at least two vials.

120. The multi-monodose container of paragraph 1180, wherein the label is adhered to an outer surface of the at least one of the at least two vials.

121. The multi-monodose container of paragraph 118, wherein the label includes at least one sensor.

122. The multi-monodose container of paragraph 121, wherein the at least one sensor includes at least one temperature sensor.

123. The multi-monodose container of paragraph 121, wherein the at least one sensor includes at least one light sensor.

124. The multi-monodose container of paragraph 121, wherein the at least one sensor includes at least one oxygen sensor.

125. The multi-monodose container of paragraph 83, wherein the folded configuration includes the first or the second planar outer surface of the second vial positioned parallel to the third or the fourth planar outer surface of the first vial.

126. The multi-monodose container of paragraph 83, wherein the folded configuration includes the first planar outer surface of the second vial positioned parallel to the fourth planar outer surface of the first vial and the second planar outer surface of the second vial and the third planar outer surface of the first vial forming part of substantially planar outer surface of the row of the at least two vials.

127. The multi-monodose container of paragraph 83, wherein the folded configuration includes the second planar outer surface of the second vial positioned parallel to the third planar outer surface of the first vial and the first planar outer surface of the second vial and the fourth planar outer surface of the first vial forming part of substantially planar outer surface of the row of the at least two vials.

128. The multi-monodose container of paragraph 83, further including a second articulating joint connecting the third edge of the second vial to a first edge of a third vial, the second articulating joint sufficiently flexible to reversibly mate a first or a second planar outer surface of the third vial with the third or the fourth planar outer surface of the second vial.

129. The multi-monodose container of paragraph 83, wherein the row of the at least two vials includes a pair of reversibly mating planar outer surfaces and a pair of non-mating planar outer surfaces, wherein the reversibly mating planar outer surfaces are parallel to one another in the folded configuration and the non-mating planar outer surfaces form a substantially planar outer surface of the row of the at least two vials in the folded configuration.

130. The multi-monodose container of paragraph 129, wherein the row of the at least two vials includes two or more pairs of reversibly mating planar outer surfaces and two or more pairs of non-mating planar outer surfaces.

131. The multi-monodose container of paragraph 83, further including a sealable cover.

132. The multi-monodose container of paragraph 131, wherein the sealable cover holds the row of the at least two vials in the folded configuration.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A multi-monodose container comprising:

a row of at least three diagonally connected identical rectangular monodose pharmaceutical vials formed from a biocompatible material, a first vial connected to an adjacent second vial through a first articulating joint, the first articulating joint sufficiently flexible to reversibly mate a planar outer surface of the first vial with a planar outer surface of the adjacent second vial, the second vial connected to an adjacent third vial through a second articulating joint, the second articulating joint sufficiently flexible to reversibly mate a second planar outer surface of the second vial with a planar outer surface of the adjacent third vial, wherein the first articulating joint and the second articulating joint are diagonally connected to the second vial, each of the at least three monodose pharmaceutical vials having an internal volume of a size and a shape to hold a single dose of an injectable pharmaceutical agent, wherein the row of the at least three monodose pharmaceutical vials is of a size and a shape to form a first rectangular packing cross-sectional area in an expanded configuration and to form a second rectangular packing cross-sectional area in a folded configuration, the second rectangular packing cross-sectional area smaller than the first rectangular packing cross-sectional area; and wherein the row of the at least three monodose pharmaceutical vials includes at least one pair of reversibly mating planar outer surfaces and at least one pair of non-mating planar outer surfaces, the row of the at least three monodose pharmaceutical vials in the folded configuration including the at least one pair of reversibly mating planar outer surfaces parallel to one another and the at least one pair of non-mating planar outer surfaces forming a substantially planar outer surface of the row of the at least three monodose pharmaceutical vials.

2. The multi-monodose container of claim 1, wherein the row of the at least three monodose pharmaceutical vials is formed from at least one biocompatible polymer suitable for blow-fill-seal manufacturing with the injectable pharmaceutical agent.

3. The multi-monodose container of claim 1, wherein each of the at least three monodose pharmaceutical vials is square in horizontal cross-section.

4. The multi-monodose container of claim 1, wherein the internal volume is about 1.0 milliliter.

5. The multi-monodose container of claim 1, wherein the injectable pharmaceutical agent comprises a vaccine.

6. The multi-monodose container of claim 1, wherein each of the at least three monodose pharmaceutical vials includes a needle-penetrable closure covering an access portion having a size and a shape suitable for insertion of an injection needle.

7. The multi-monodose container of claim 1, further comprising a label associated with at least one of the at least three monodose pharmaceutical vials, the label including at least one sensor.

8. The multi-monodose container of claim 7 wherein the at least one sensor includes at least one of a temperature sensor, a light sensor, or an oxygen sensor.

9. The multi-monodose container of claim 1, further comprising an inert gas, wherein the inert gas and the single dose of the injectable pharmaceutical agent are sealed in the internal volume of each of the at least three monodose pharmaceutical vials.

10. A multi-monodose container comprising:

a row of at least three diagonally connected identical monodose pharmaceutical vials formed from a biocompatible thermoplastic material suitable for blow-fill-seal manufacturing, each of the at least three monodose pharmaceutical vials having four walls connected to a rectangular base to define an internal volume of a size and a shape to hold a single dose of an injectable pharmaceutical agent, each of the four walls including a planar outer surface, a first planar outer surface and a second planar outer surface defining a first edge therebetween, the second planar outer surface and a third planar outer surface defining a second edge therebetween, the third planar outer surface and a fourth planar outer surface defining a third edge therebetween, and the fourth planar outer surface and the first planar outer surface defining a fourth edge therebetween, each of the at least three monodose pharmaceutical vials having a twistable cap or tab covering an access portion suitable for insertion of an injection needle;

an articulating joint connecting the third edge of a first vial to the first edge of a second vial, the articulating joint sufficiently flexible to reversibly mate the first or the second planar outer surface of the second vial with the third or fourth planar outer surface of the first vial; and a second articulating joint connecting the third edge of the second vial to the first edge of the third vial, the second articulating joint sufficiently flexible to reversibly mate the first or the second planar outer surface of the third vial with the third or the fourth planar outer surface of the second vial;

wherein the row of the at least three monodose pharmaceutical vials has a size and a shape to form a first rectangular packing cross-sectional area in an expanded configuration and to form a second rectangular packing cross-sectional area in a folded configuration, the second rectangular packing cross-sectional area smaller than the first rectangular packing cross-sectional area, wherein the folded configuration includes the first or the second planar outer surface of the second vial positioned parallel to the third or the fourth planar outer surface of the first vial and the first or the second planar outer surface of the third vial positioned parallel to the third or the fourth planar outer surface of the second vial.

11. The multi-monodose container of claim 10, wherein the at least three monodose pharmaceutical vials, the articulating joint, and the second articulating joint are formed from at least one biocompatible thermoplastic material suitable for blow-fill-seal manufacturing with the injectable pharmaceutical agent.

12. The multi-monodose container of claim 10, wherein the internal volume of each of the at least three monodose pharmaceutical vials is about 1.0 milliliter.

13. The multi-monodose container of claim 10, wherein the internal volume of each of the at least three monodose pharmaceutical vials is about 0.2 milliliter to about 10 milliliters.

14. The multi-monodose container of claim 10, wherein each of the at least three monodose pharmaceutical vials includes a needle-penetrable closure covering the access portion having a size and a shape suitable for insertion of the injection needle.

15. The multi-monodose container of claim 10, wherein each of the at least three monodose pharmaceutical vials includes a needle-penetrable insert covering the access portion having a size and a shape suitable for insertion of the injection needle.

16. The multi-monodose container of claim 10, wherein each of the at least three monodose pharmaceutical vials is square in horizontal cross-section.

17. The multi-monodose container of claim 10, wherein the internal volume of each of the at least three monodose pharmaceutical vials is about 0.5 milliliters.

18. The multi-monodose container of claim 10, wherein the internal volume of each of the at least three monodose pharmaceutical vials is about 0.1 to about 3.0 milliliters.

19. The multi-monodose container of claim 10, wherein the injectable pharmaceutical agent comprises a vaccine.

20. The multi-monodose container of claim 10, wherein the at least three monodose pharmaceutical vials comprises at least one of three vials, four vials, five vials, six vials, seven vials, eight vials, nine vials, or ten vials.

21. The multi-monodose container of claim 10, wherein at least one of the first edge, the second edge, the third edge, and the fourth edge of each of the at least three monodose pharmaceutical vials comprises a double-beveled edge.

22. The multi-monodose container of claim 21, wherein the articulating joint connects the double-beveled edge of the third edge of the first vial and the double-beveled edge of the first edge of the second vial, wherein the articulating joint is sufficiently flexible to reversibly mate a beveled surface of the double-beveled edge of the third edge of the first vial with a beveled surface of the double-beveled edge of the first edge of the second vial; and wherein the second articulating joint connects the double-beveled edge of the third edge of the second vial and the double-beveled edge of the first edge of the third vial, wherein the second articulating joint is sufficiently flexible to reversibly mate a beveled surface of the double-beveled edge of the third edge of the second vial and a beveled surface of the double-beveled edge of the first edge of the third vial.

23. The multi-monodose container of claim 10, further comprising a label including at least one sensor associated with at least one of the at least three monodose pharmaceutical vials.

24. The multi-monodose container of claim 23, wherein the label is printed on an outer surface of the at least one of the at least three monodose pharmaceutical vials.

25. The multi-monodose container of claim 23, wherein the at least one sensor includes at least one temperature sensor.

26. The multi-monodose container of claim 23, wherein the at least one sensor includes at least one of a light sensor or an oxygen sensor.

27. The multi-monodose container of claim 10, further comprising an inert gas, wherein the inert gas and the single dose of the injectable pharmaceutical agent are sealed in the internal volume of each of the at least three monodose pharmaceutical vials.

* * * * *